US007478629B2

(12) United States Patent
del Valle Bravo et al.

(10) Patent No.: US 7,478,629 B2
(45) Date of Patent: Jan. 20, 2009

(54) AXIAL FLOW SUPERCHARGER AND FLUID COMPRESSION MACHINE

(76) Inventors: Facundo del Valle Bravo, 528 Sunset, White Lake, MI (US) 48383; Jose L. Correa, 2122 Baywood Dr., Fullerton, CA (US) 92833

( * ) Notice: Subject to any disclaimer, the term of this patent is extended or adjusted under 35 U.S.C. 154(b) by 0 days.

(21) Appl. No.: 11/266,757

(22) Filed: Nov. 3, 2005

(65) Prior Publication Data

US 2006/0182626 A1 Aug. 17, 2006

Related U.S. Application Data

(60) Provisional application No. 60/624,824, filed on Nov. 4, 2004.

(51) Int. Cl.

| | |
|---|---|
| ***F02B 33/00*** | (2006.01) |
| ***F01D 9/00*** | (2006.01) |
| ***F01D 17/00*** | (2006.01) |
| ***F01D 1/00*** | (2006.01) |
| ***F04D 31/00*** | (2006.01) |

(52) U.S. Cl. ..... 123/559.1; 123/559.3; 123/565; 415/199.5; 415/145; 415/149.2; 415/116; 415/189; 415/219.1

(58) Field of Classification Search ..... 123/559.1, 123/559.3, 565; 415/149.2, 17, 26, 116, 415/189, 219.1, 194, 191, 199.5, 145; 417/406; 439/147; 416/193 A See application file for complete search history.

(56) References Cited

U.S. PATENT DOCUMENTS

| | | | | |
|---|---|---|---|---|
| 1,865,551 | A * | 7/1932 | Belluzzo | 415/145 |
| 1,993,963 | A | 3/1935 | Heinze | 417/406 |
| 2,232,483 | A | 2/1941 | Shiplette | 60/624 |
| 2,361,887 | A * | 10/1944 | Traupel | 415/145 |
| 2,379,183 | A | 6/1945 | Price | 417/47 |
| 2,386,096 | A | 10/1945 | Ehrling | 60/602 |
| 2,404,324 | A | 7/1946 | Staley | 415/17 |
| 2,507,946 | A | 5/1950 | Waeber | 60/607 |
| 2,644,295 | A | 7/1953 | Peterson | 60/607 |
| 2,652,685 | A | 9/1953 | Willgoos | |

(Continued)

FOREIGN PATENT DOCUMENTS

JP 62282190 A * 12/1987

OTHER PUBLICATIONS

Popular Hot Rodding; "the secret to incredible performance, reliability and drivability . . . is in the value of our valve," Nov. 2003; p. 83.
Belt-Driven Basics; www.50mustangandsuperfords.com; Oct. 2003; pp. 170-176.
The Axial Flow Supercharger; www.axialflow.com; date unknown; 2 Pages.
Axial Flow Supercharger; www.rx8club.com; May 2004; 5 Pages.
SilentDrive™ Belt Drive; www.powerdyne.com/silentdr.htm; date unknown; 1 Page.

(Continued)

*Primary Examiner*—Thai-Ba Trieu
(74) *Attorney, Agent, or Firm*—Harness, Dickey & Pierce, P.L.C.

(57) ABSTRACT

A compression and vacuum-producing machine includes a housing, at least one rotating disk having a plurality of blades rotationally supported within the housing, and at least one stationary disk having a plurality of blades fixedly attached to the housing. A drive shaft includes a generally tapered surface and rotatably drives the rotating disks to increase the energy of a fluid stream disposed within the housing. The compression machine includes a transmission in mechanical communication with the drive shaft to convert a rotational input to a desired rotational speed and drive the shaft at the desired speed.

18 Claims, 18 Drawing Sheets

U.S. PATENT DOCUMENTS

| | | | | | |
|---|---|---|---|---|---|
| 2,687,613 | A | | 8/1954 | Craigon | 60/607 |
| 2,785,849 | A | * | 3/1957 | Stalker | 415/199.5 |
| 2,924,292 | A | * | 2/1960 | Hickman | 415/145 |
| 2,959,394 | A | * | 11/1960 | Halford et al. | 415/194 |
| 2,978,169 | A | * | 4/1961 | Stanton | 415/145 |
| 3,032,260 | A | | 5/1962 | Latham | 415/190 |
| 3,112,866 | A | * | 12/1963 | Fortescue | 415/194 |
| 3,194,487 | A | * | 7/1965 | Tyler et al. | 415/199.5 |
| 3,375,665 | A | * | 4/1968 | Gyarmathy | 415/219.1 |
| 3,484,039 | A | * | 12/1969 | Mittelstaedt | 415/145 |
| 3,514,952 | A | * | 6/1970 | Schumacher et al. | 60/225 |
| 3,775,023 | A | * | 11/1973 | Davis et al. | 415/199.5 |
| 3,865,504 | A | * | 2/1975 | Benz | 415/199.5 |
| 3,997,280 | A | * | 12/1976 | Germain | 415/189 |
| 4,145,888 | A | | 3/1979 | Roberts | 60/608 |
| 4,197,700 | A | | 4/1980 | Jahnig | 60/774 |
| 4,406,125 | A | | 9/1983 | Rahnke | 60/602 |
| 4,438,995 | A | * | 3/1984 | Fisher et al. | 439/147 |
| 4,485,310 | A | | 11/1984 | de Valroger | |
| 4,485,793 | A | | 12/1984 | Oguma | 123/559.3 |
| 4,530,338 | A | | 7/1985 | Sumi | 123/559.3 |
| 4,606,700 | A | * | 8/1986 | Brudny-Chelyadinov et al. | 415/199.5 |
| 4,693,669 | A | | 9/1987 | Rogers, Sr. | 415/143 |
| 4,815,428 | A | | 3/1989 | Bunk | 123/559.1 |
| 5,012,906 | A | | 5/1991 | Meyer et al. | |
| 5,541,857 | A | * | 7/1996 | Walter et al. | 415/26 |
| 5,605,045 | A | | 2/1997 | Halimi et al. | 60/607 |
| 5,638,796 | A | | 6/1997 | Adams, III et al. | 123/565 |
| 5,755,554 | A | * | 5/1998 | Ryall | 415/199.4 |
| 5,904,045 | A | | 5/1999 | Kapich | 60/609 |
| 5,911,679 | A | | 6/1999 | Farrell et al. | 415/149.2 |
| 6,058,916 | A | | 5/2000 | Ozawa | 123/559.3 |
| 6,135,098 | A | | 10/2000 | Allen et al. | 123/565 |
| 6,270,315 | B1 | | 8/2001 | Greim et al. | 415/195.5 |
| 6,289,882 | B1 | | 9/2001 | Slicker | 123/559.3 |
| 6,328,024 | B1 | | 12/2001 | Kibort | 123/565 |
| 6,352,404 | B1 | * | 3/2002 | Czachor et al. | 415/116 |
| 6,360,731 | B1 | | 3/2002 | Chang | 123/559.1 |
| 6,537,169 | B1 | | 3/2003 | Morii | 475/8 |
| 6,589,013 | B2 | * | 7/2003 | Abdallah | 415/199.2 |
| 6,609,505 | B2 | | 8/2003 | Janson | 123/559.1 |
| 6,634,344 | B2 | | 10/2003 | Stretch | 123/559.3 |
| 6,705,834 | B1 | * | 3/2004 | Jacobsson | 415/199.5 |
| 7,094,024 | B2 | * | 8/2006 | Nguyen et al. | 415/204 |
| 7,270,512 | B2 | * | 9/2007 | Sullivan et al. | 415/199.5 |
| 2002/0182063 | A1 | | 12/2002 | Edsinger | 123/559.1 |
| 2005/0150483 | A1 | | 7/2005 | Sorensen et al. | 123/559.1 |

OTHER PUBLICATIONS

Photo of axial flow supercharger generally; http://www.rx8club.com/showthread.php?t=29778; May 29, 2004; 1 Page.

Photo of internal blade components of an axial flow supercharge; http://www.rx8club.com/showthread.php?t=29778; May 29, 2004; 1 Page.

Photo of end view of an axial flow supercharger showing inlet; http://www.rx8club.com/showthread.php?t=29778; May 29, 2004; 1 Page.

Photo of compressor components of an axial flow supercharger; http://www.rx8club.com/showthread.php?t=29778; Aug. 24, 2004; 1 Page.

Photo of rotor components of an axial flow supercharger; http://www.rx8club.com/showthread.php?t=29778; Aug. 24, 2004; 1 page.

Photo of rotor and stator components of the compressor of an axial flow supercharger; http://www.rx8club.com/showthread.php?t=29778; Aug. 24, 2004; 1 Page.

* cited by examiner

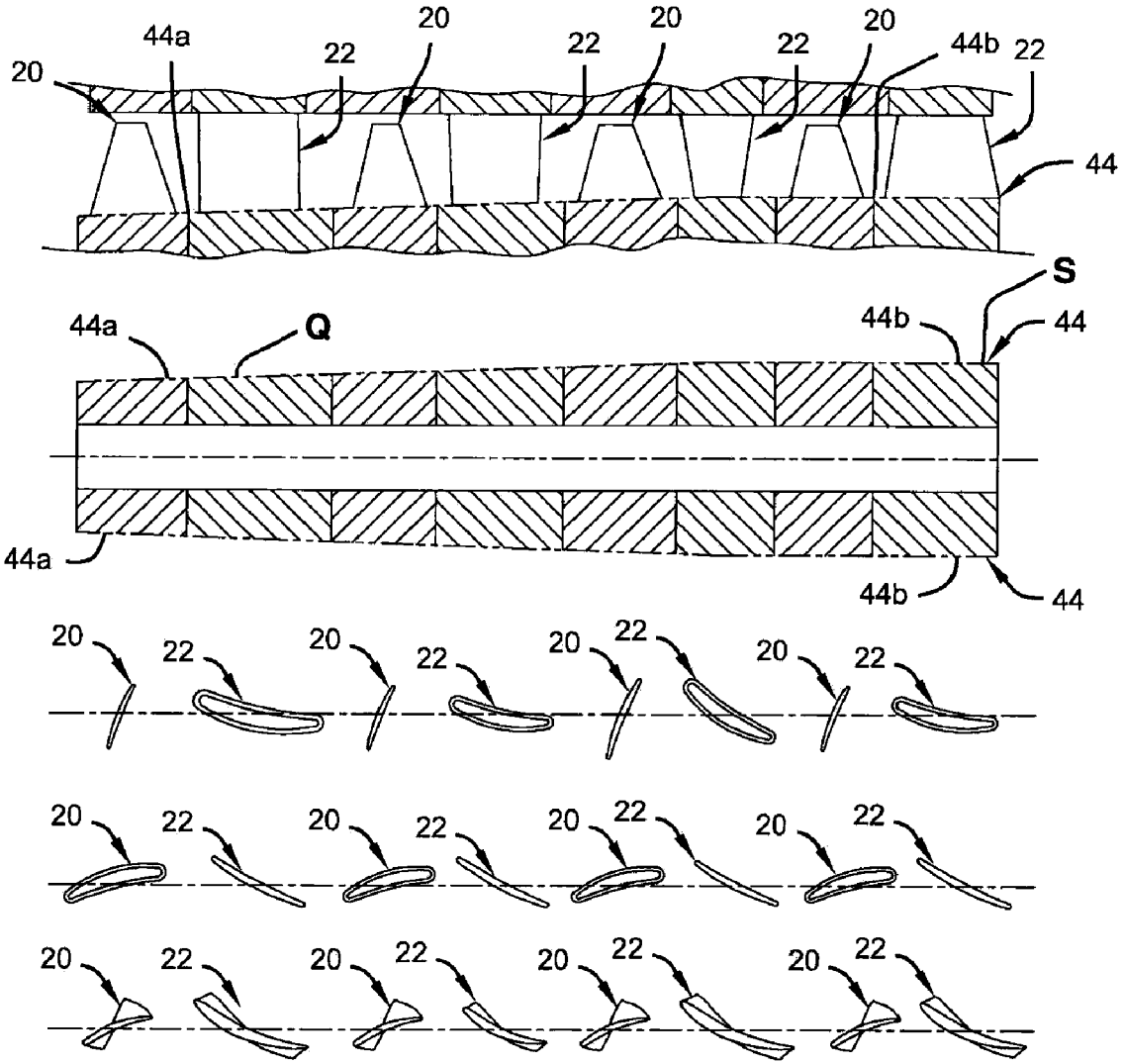
20
44a
22
20
22
20
22
20
44b
22
44
S
44
44b
44b
Q
44a
44a
20
22
20
22
20
22

AXIAL FLOW SUPERCHARGER AND FLUID COMPRESSION MACHINE

CROSS-REFERENCE TO RELATED APPLICATIONS

This application claims the benefit of U.S. Provisional Application No. 60/624,824, filed on Nov. 4, 2004. The disclosure of the above application is incorporated herein by reference.

FIELD

The present teachings relate generally to compression and vacuum-producing machines, and more particularly to axial-type compression and vacuum-producing machines.

BACKGROUND

Compression and vacuum-producing machines are used in a variety of commercial and residential applications to provide a compressed stream of fluid or to extract fluid, respectively. In commercial applications, compression machines are used in devices such as de-icing machines and fire trucks to deliver a compressed fluid (i.e., de-icing fluid and water, respectively). In residential applications, compression machines are used in residential applications such as leaf blowers to disperse yard waste (i.e., leaves, grass clippings, etc.) or in inflatable devices such as yard balloons to maintain an inflated state of the balloon. Furthermore, compression machines are also utilized in residential and commercial vehicles to provide a desired boost in engine performance. Vacuum-producing machines are used in commercial and residential appliances such as vacuum cleaners to provide a desired fluid force suitable to collect waste.

A supercharger is a compression machine that increases the induction pressure of an internal combustion engine. The higher induction pressure creates a higher output power of the engine due the increased air pressure received by each combustion chamber of the engine. In addition, the increased pressure helps to increase the engine power by completely releasing combustion gases and allowing more fuel to be delivered to each chamber. In spark-ignition engines, the range of pressure provided by the supercharger is limited to less than 10 psig by pre-ignition conditions created by the fuel octane number. In diesel cycle engines, such a limitation does not exist. However, for either application, the supercharger must produce a requisite pressure and airflow to each chamber to accommodate a complete range of operation of the engine. In other words, the response of the supercharger must be matched with engine requirements.

Most known superchargers are positive-displacement type superchargers, which allow for simple matching of air delivery and engine requirements. However, while adequately meeting the requisite air requirement, conventional superchargers typically suffer from low efficiency. In addition, the general configuration and high inertia of conventional supercharger components practically precludes the possibility of disconnecting the supercharger from the engine by mechanical means. Therefore, conventional superchargers also suffer from the disadvantage of requiring high power from the engine even when an air boost is not needed, thereby resulting in poor vehicle mileage.

Conventional positive-displacement superchargers typically require high-precision component parts and tight tolerances between such parts to avoid air leaks during rotational movement and air compression. Such high-precision, smalltolerance designs typically mandate a heavy construction to avoid distortions of, and contact between, high-velocity rotating parts. In addition, the inherent low adiabatic efficiency of such superchargers increases the temperature of the air delivered, and thus typically requires cooling with air-to-air heat exchangers or with a radiator and water-circulation system, thereby further increasing the weight and complexity of the system. The complexity and overall weight of conventional superchargers results in a generally inefficient machine and, as such, reduce the overall efficiency of the vehicle to which the supercharger may be tied.

In addition to car and light truck applications, superchargers are also used in heavy transportation, high performance, and racecar applications. Such high-performance superchargers are typically centrifugal-type superchargers and include a higher efficiency than a positive-displacement type supercharger. While centrifugal superchargers have an improved efficiency from positive-displacement type superchargers, centrifugal superchargers suffer from the disadvantage of requiring a bulky and large design to function properly. Such large designs are difficult to apply in cars and light trucks that typically have low profile covers for the engine compartment, and thus, are not practical in such applications.

In addition to positive-type displacement and centrifugal superchargers, turbochargers are also used to increase the pressure of an air stream delivered to an engine. Turbochargers utilize hot gas from an engine exhaust to further compress ambient air delivered to the engine. Hot gas from the engine exhaust is passed through a turbine connected to a centrifugal compressor, thereby compressing the ambient air and delivering a compressed air stream to chambers of the engine. Turbochargers are high-precision machines, requiring special materials, components, and lubrication from the engine system. The delay of the response created by the need for higher exhaust conditions to drive the input turbine and the complex regulation needed for the high-temperature exhaust gases often result in application and reliability problems.

While positive-displacement superchargers, centrifugal superchargers, and turbochargers adequately deliver a compressed stream of air to each combustion chamber of an engine, each system suffers from the disadvantage of requiring a complex design and a large space in which to package the system. Therefore, a supercharger that is easily packaged in an engine compartment of a vehicle is desirable in the industry. Furthermore, a supercharger that provides a low weight construction, high efficiency output, avoids water cooling of compressed air, works with a minimum rotational speed, has a low production cost, is easily installed, and has a high reliability is also desirable.

SUMMARY

Accordingly, a compression and vacuum producing machine is provided and includes a housing, at least one rotating disk having a plurality of blades rotationally supported within the housing, and at least one stationary disk having a plurality of blades fixedly attached to the housing. A drive shaft includes a generally tapered surface and rotatably drives the rotating disks to increase the energy of a fluid stream disposed within the housing. The compression machine includes a transmission in mechanical communication with the drive shaft to convert a rotational input to a desired rotational speed and drive the shaft at the desired speed.

BRIEF DESCRIPTION OF THE DRAWINGS

The present teachings will become more fully understood from the detailed description and the accompanying drawing, wherein:

FIG. 5*a* is a partial sectional view showing rotating disks assembled to a drive shaft and stationary disks assembled to a housing;

FIG. 5*b* is a sectional view of the drive shaft of FIG. 5*a;*

FIG. 5*c* is a partial sectional view of a tip section of the rotating and stationary disks of FIG. 5*a;*

FIG. 5*d* is a partial sectional view of a root section of the rotating and stationary disks of FIG. 5*a;*

FIG. 5*e* is a top view of the rotating and stationary disks of FIG. 5*a;*

DESCRIPTION

The following description is merely exemplary in nature and is in no way intended to limit the teachings, its application, or uses.

With reference to the figures, an axial-type compression machine 10 is provided and includes a compressor 12, a transmission 14, and a diffuser 16. The compressor 12 is driven by an output of the transmission 14 and serves to provide a compressed fluid to an external system at a predetermined flow, velocity, and pressure via diffuser 16.

The compression machine 10 may be used in a variety of applications to provide a stream of compressed air. For example, the compression machine 10 may be used in a light-duty and/or a heavy-duty car and truck application to provide air at an increased pressure to an engine of the car or truck. Further, the compression machine 10 may be used in conjunction with a fuel cell system to deliver air, hydrogen, and/or water under pressure to or from the fuel cell. Further yet, the compression machine may be used to deliver a cool and compressed stream of air to a braking system of a racecar or truck to help maintain the brakes of the system at a desired temperature.

The compression machine 10 may also be used to provide a vacuum, rather than a compressed stream of air. For example, the compression machine 10 may be used in a residential or commercial high-power vacuum cleaner or may be used in a commercial application as a blower to evacuate a room or building or as the pressure or vacuum source for pneumatic conveying.

Figure 2:
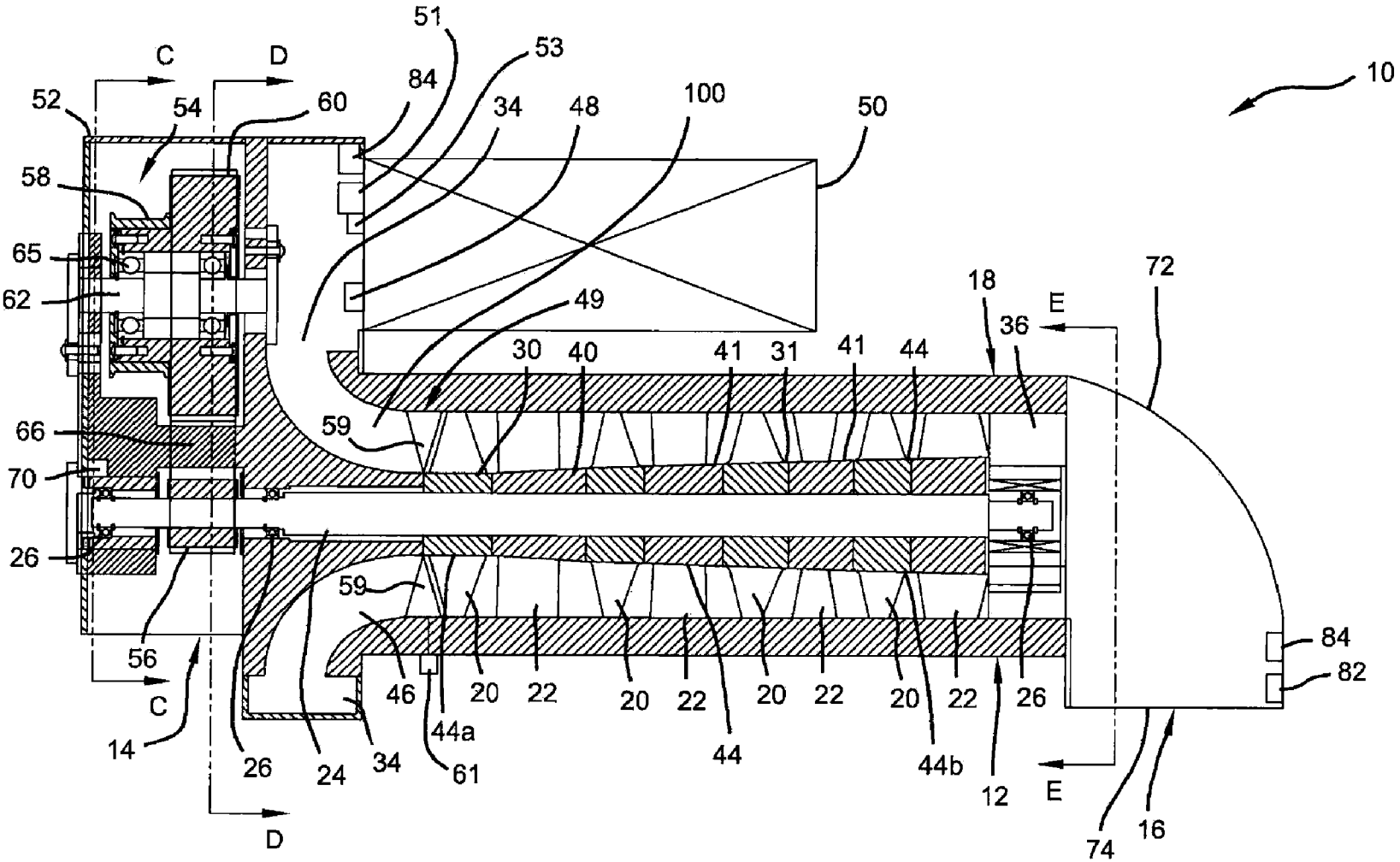
FIG. 2 is a cross-section taken-along line A-A of the compression machine of FIG. 1.

With particular reference to FIG. 2, the compressor 12 is shown to include a housing 18, a series of rotating disks 20, a series of stationary disks 22, and a drive shaft 24. The drive shaft 24 extends generally along the length of the compressor 12 and transmission 14 and is rotatably supported by a series of two to four bearings 26. In addition, the drive shaft 24 fixedly supports each of the rotating disks 20 and rotatably extends through each of the stationary disks 22 such that each of the rotating disks 20 rotate with the drive shaft 24 relative to the stationary disks 22 and housing 18.

The compressor 12 is shown to include four stages with each stage including a rotating disk 20 and a stationary disk 22. The first stage includes a first rotating disk 20 having eight blades 28 with a mean height of 1.3966" and a first stationary disk 22 having five blades 38 with a mean height of 1.4510." The first stage may also include a stationary disk 22 disposed upstream of the first rotating disk 20 such that incoming air contacts the stationary disk 22 before contacting the first rotating disk 20. Such a configuration essentially positions a stationary disk 22 on both sides of the rotating disk 20. The stationary disk 22 disposed upstream of the first rotating disk 20 may include blades that may be opened and closed to selectively restrict flow to the first rotating disk 20.

The second stage includes a second rotating disk 20 having nine blades 28 with a mean height of 1.2681" and a second stationary disk 22 having seven blades 38 with a mean height of 1.2181." The third stage includes a third rotating disk 20 having eight blades 28 with a mean height of 1.1634" and a third stationary disk 22 having five blades 38 with a mean height of 1.1081." The fourth stage includes a fourth rotating disk 20 having nine blades 28 with a mean height of 1.0718" and a fourth stationary disk 22 having 14 blades 38 with a mean height of 1.0414."

While a compressor 12 having four stages is disclosed, it should be understood that the compressor 12 could include fewer or more stages, depending on the particular application to which the compressor 12 is used. Furthermore, it should be understood that the number of blades at each stage for both the rotating disks 20 and stationary disks 22 may be increased or decreased to tailor the performance and output of the compressor 12 and that the heights of the respective blades may similarly be adjusted.

A compression machine 10 for a small automotive engine may have rotating disks 20 having up to 40 blades with only 0.25" height in the first row of blades. In contrast, a compression machine 10 for a large marine engine or blower may have a 12" diameter with 2" height in the first row blades. Either compression machine 10 may have any number of stages.

Choosing the number, size, and blade configuration of the rotating disks 20 and stationary disks 22 may be accomplished though actual device testing. For example, a vehicle incorporating the compressor 12 may be tested to determine the configuration of the compressor 12 best suited for the particular device. Laboratory testing such as a flow-bench test may be used to supplement actual device testing to reduce testing and prototype component costs. Laboratory testing may also be used to generate performance curves for use in correlating actual device tests and for determining the overall number, size, and blade configuration of the rotating disks 20 and stationary disks 22 when actual device testing is unavailable or impractical. For example, in early stages of design, when prototype compressor and device components are not typically available, performance curves from previous testing may be used to guide the design of the compressor 12 (i.e., number, size, and blade configuration of the rotating disks 20 and stationary disks 22).

Figure 3B:
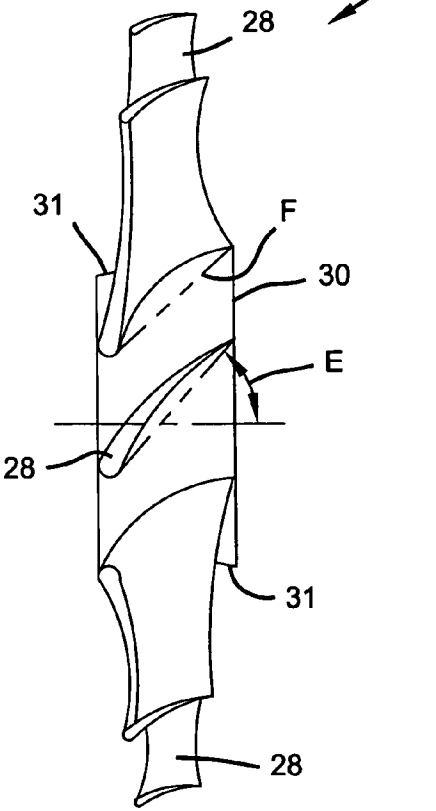
FIG. 3*b* is a side view of the rotating disk of FIG. 3*a;*
Figure 3A:
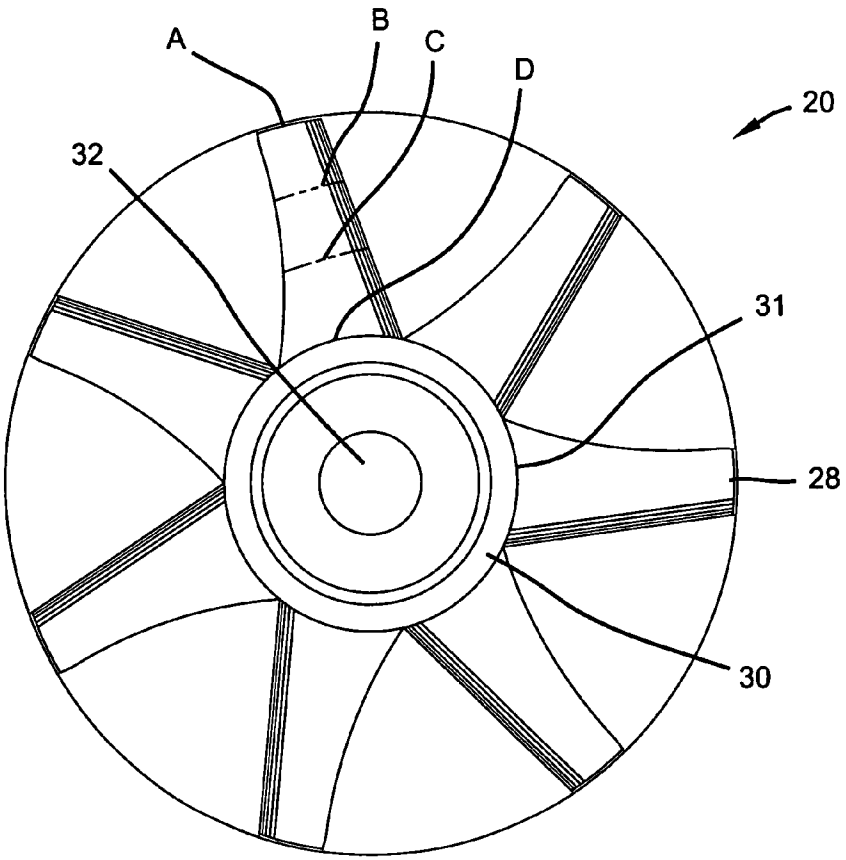
FIG. 3*a* is a front view of a rotating disk according to the present teachings.

With reference to FIGS. 3*a*-3*b*, the rotating disks 20 are shown to include a plurality of aerodynamic blades 28 extending from an axial hub 30. The hub 30 includes a tapered surface 31 that defines a generally tapered profile of the rotating and stationary disks 20, 22 when assembled to the drive shaft 24. The hub 30 of each rotating disk 20 includes a central attachment aperture 32 for fixedly attaching the rotating disk 20 to the drive shaft 24.

Figure 4B:
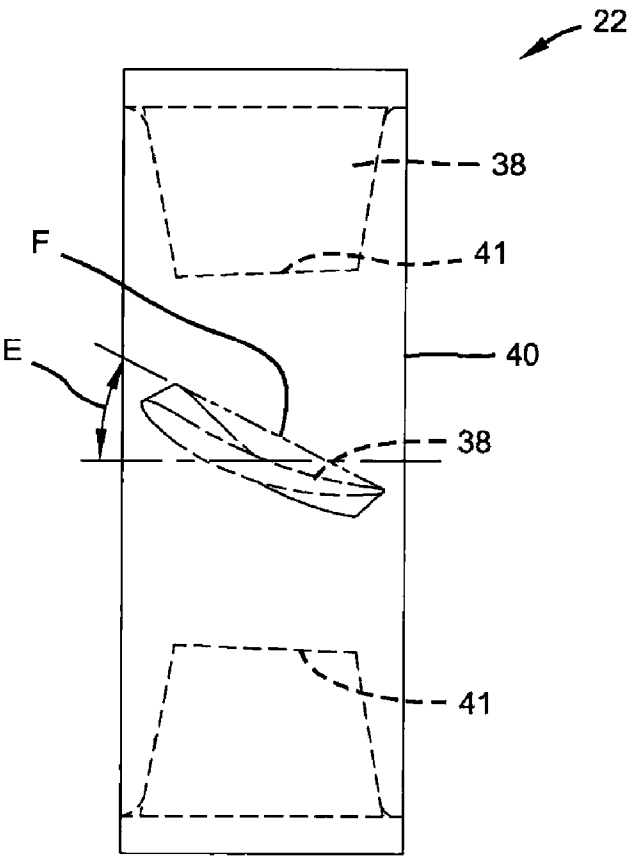
FIG. 4*b* is a side view of the stationary disk of FIG. 4*a;*
Figure 4A:
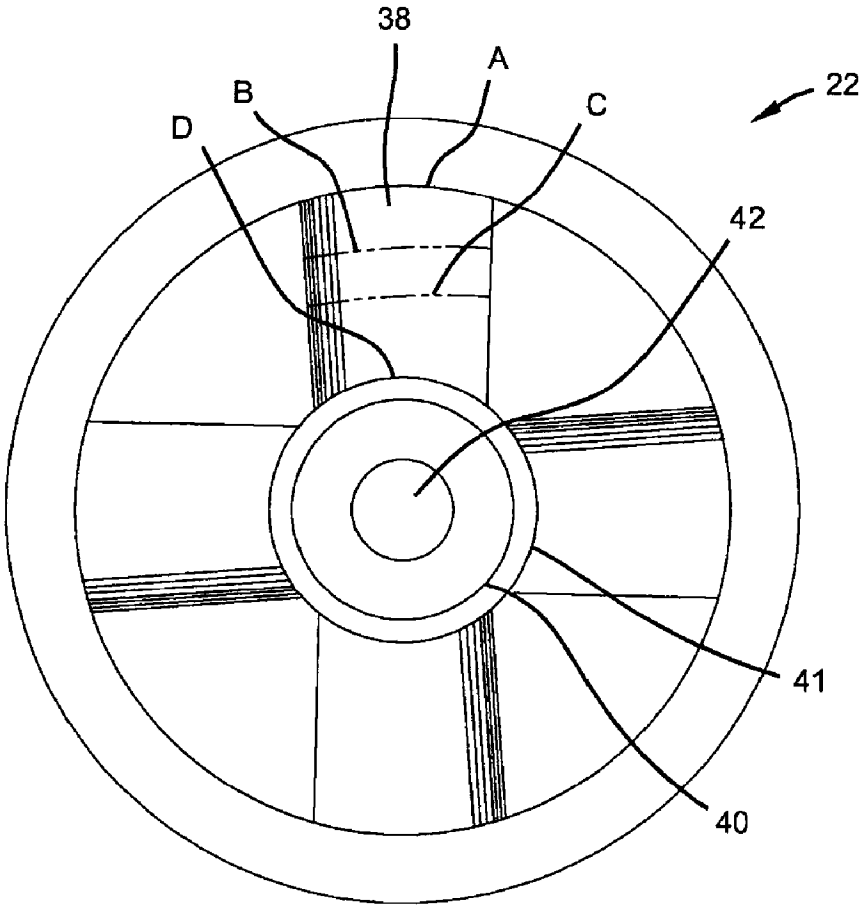
FIG. 4*a* is a front view of a stationary disk according to the present invention.
Figure 6:
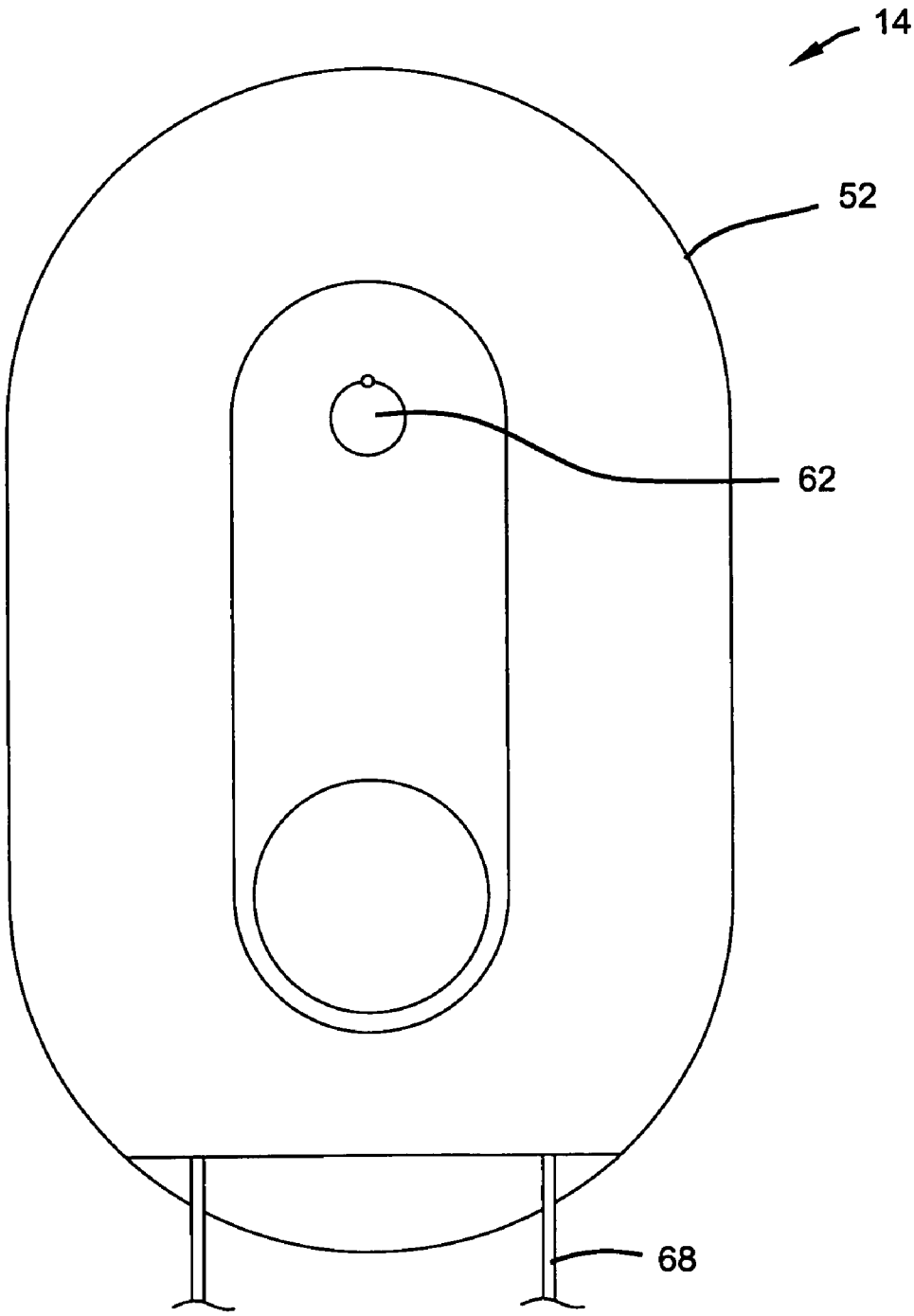
FIG. 6 is an end view of the compression machine of F*ig*. 2.
Figure 7:
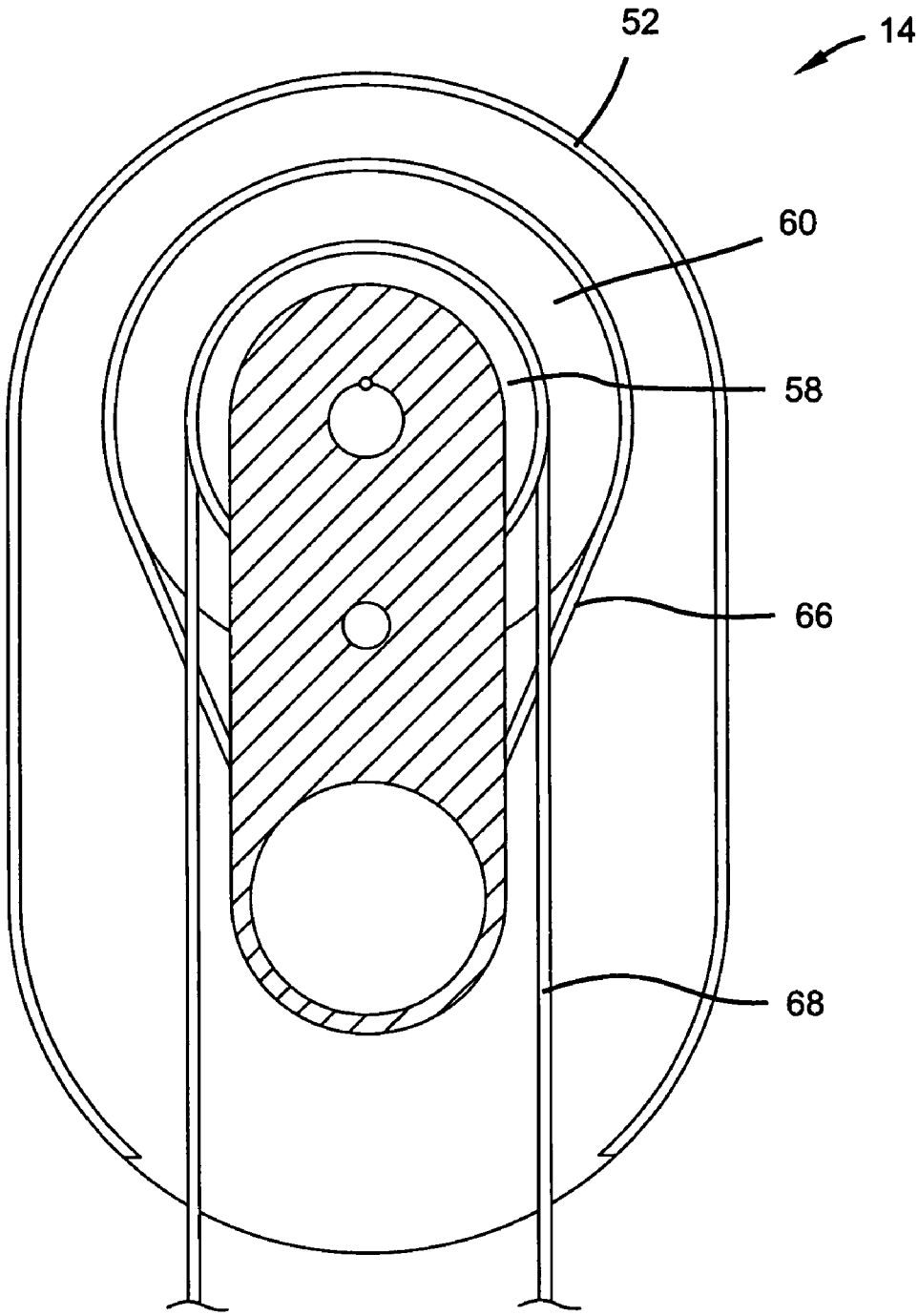
FIG. 7 is a cross-section taken along line C-C of the compression machine of FIG. 2.
Figure 8:
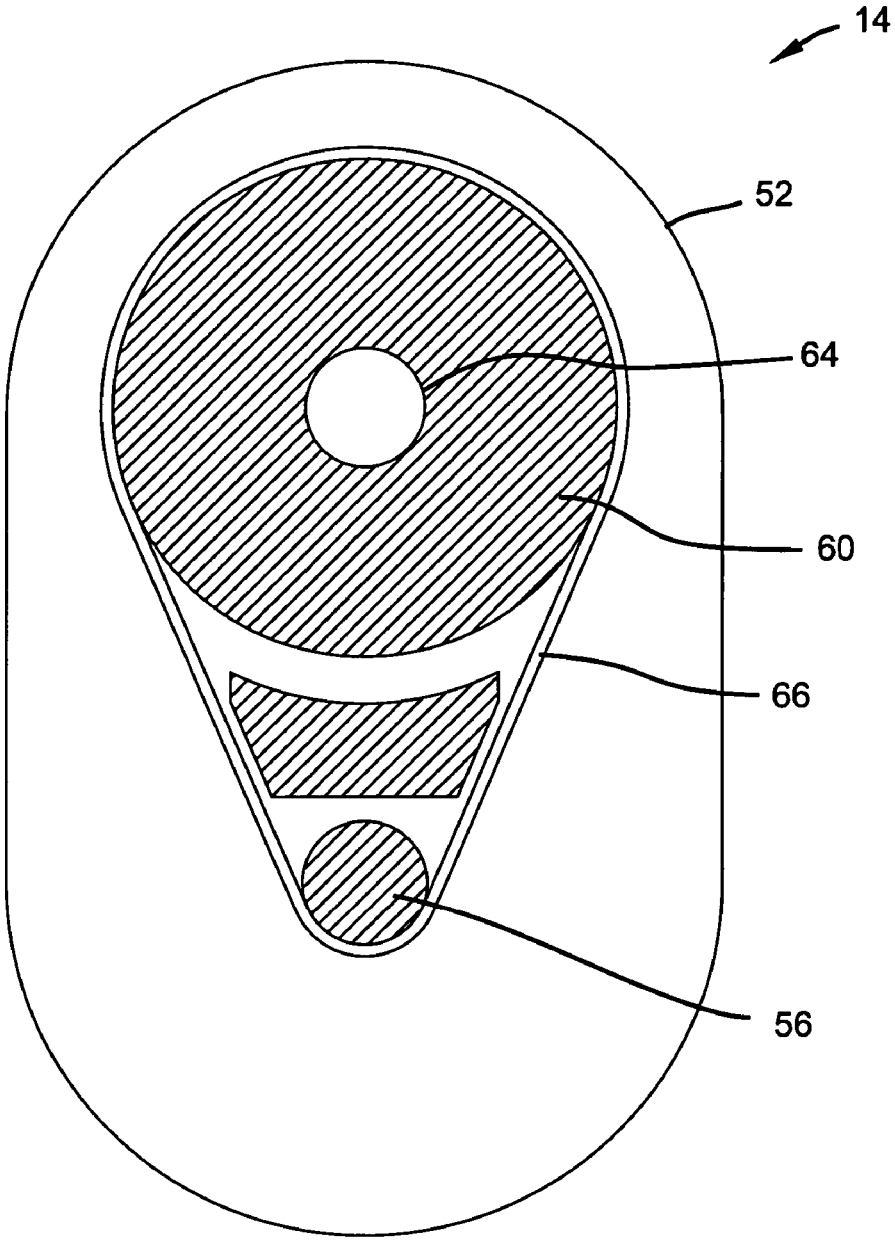
FIG. 8 is a cross-section taken along line D-D of the compression machine of FIG. 2.
Figure 9:
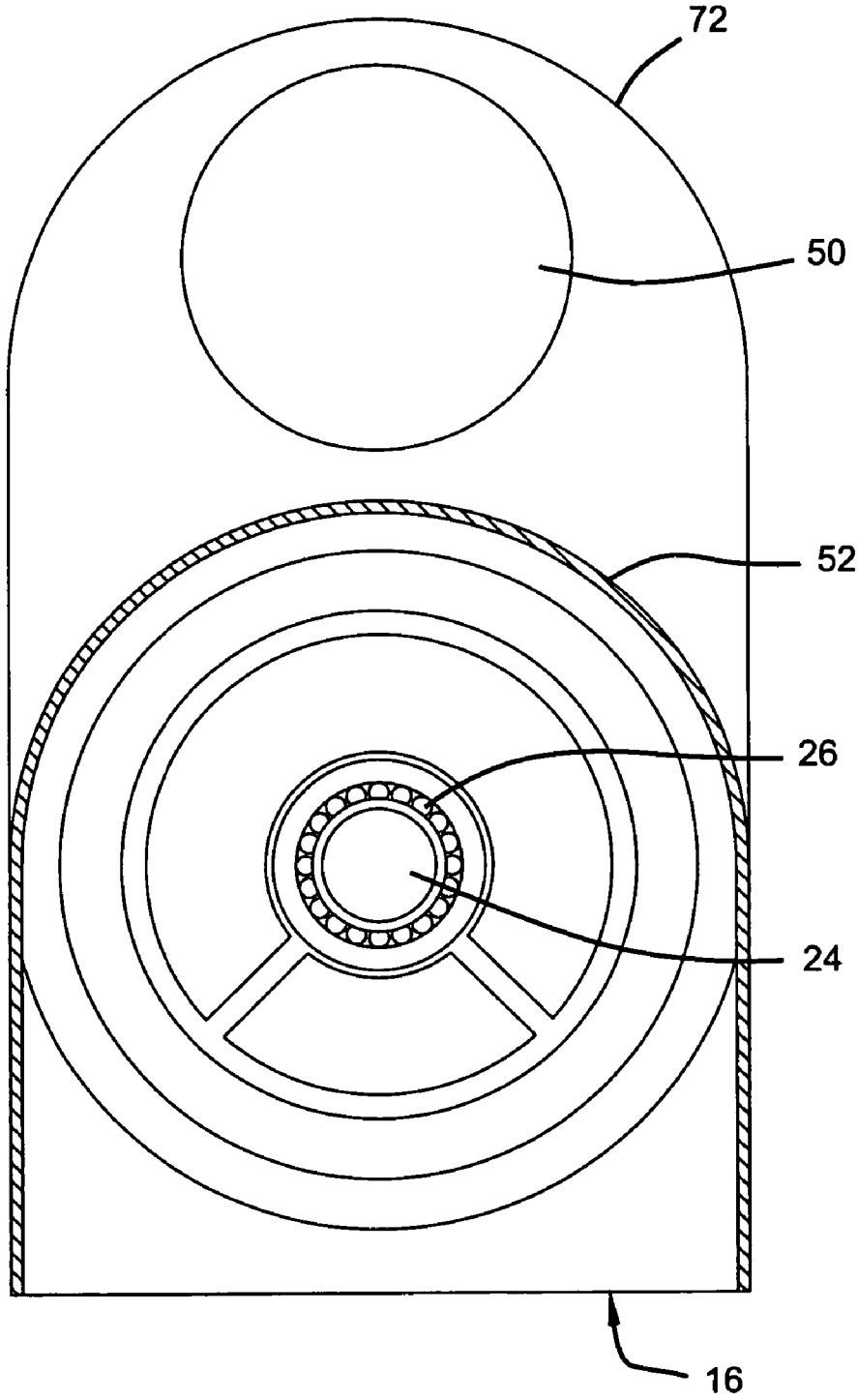
FIG. 9 is a cross-section taken along line E-E of the compression machine of FIG. 2.

With reference to FIGS. 4*a*-4*b*, each stationary disk 22 is shown to include a plurality of blades 38 extending from the housing 18 to an axial hub 40. The hub 40 includes a tapered surface 41 that defines a generally tapered profile of the rotating and stationary disks 20, 22 when assembled to the drive shaft 24. The stationary disks 22 also include a central aperture 42 for allowing the drive shaft 24 to rotatably pass therethrough. The stationary disks 22 are fixedly attached to the housing 18 such that the stationary disks 22 are restricted from rotating relative to the drive shaft 24 and rotating disks 20.

With reference to FIGS. 3*a*-5*e*, the blades 28, 38 of each stage (i.e., 1-8) have an airfoil profile and are curved to follow the direction of the airflow on each particular section. The surfaces of the blades 28, 38 are smoothly connected to provide a continuous path for the fluid, from the root to the tip of each blade 28, 38, with intermediate and mean sections on the blade height. The geometry of each blade 28, 38 is defined by a tip section A, a mean section B, an intermediate section C, a root section D, an incidence angle E, and a chord length F for each one of the sections.

As an example, the geometry of the blades 28, 38 for each stage will be described. While specific geometries are given for each blade 28, 38, it should be understood that the blade shape may be varied to adjust an output of the compression machine 10.

The first stage rotating blades 28 include a tip section having a chord length of 0.9250" with an incidence angle of 63.79 degrees, a mean section having a chord length of 0.9743" with an incidence angle of 52.60 degrees, and an intermediate section having a chord length of 1.1936" with an incidence angle of 33.10 degrees. The root section has a chord length of 1.2715" with an incidence angle of 12.40 degrees. The first stage stationary blades 38 include a tip section having a chord length of 1.8709" with an incidence angle of −12.4 degrees, a mean section having a chord length of 1.9202" with an incidence angle of −15.6 degrees, and an intermediate section having a chord length of 1.9716" with an incidence angle of −20.4 degrees. The root section has a chord length of 1.9968" with an incidence angle of −23.8 degrees.

The second stage rotating blades 28 include a tip section having a chord length of 0.8657" with an incidence angle of 62.73 degrees, a mean section having a chord length of 0.9175" and an incidence angle of 52.35 degrees, and an intermediate section having a chord length of 1.0712" with an incidence angle of 34.47 degrees. The root section has a chord length of 1.1344" with an incidence angle of 15.30 degrees. The second stage stationary blades 38 include a tip section having a chord length of 1.3857" with an incidence angle of −15.6 degrees, a mean section having a chord length of 1.3874" with an incidence angle of −19.6 degrees, and an intermediate section having a chord length of 1.3894" with an incidence angle of −24.2 degrees. The root section has a chord length of 1.3959" with an incidence angle of −28.5 degrees.

The third stage rotating blades 28 include a tip section having a chord length of 1.0237" with an incidence angle of 61.72 degrees, a mean section having a chord length of 1.0874" with an incidence angle of 50.97 degrees, and an intermediate section having a chord length of 1.2407" with an incidence angle of 35.50 degrees. The root section has a chord length of 1.3062" with an incidence angle of 16.92 degrees. The third stage stationary blades 38 include a tip section having a chord length of 1.7267" with an incidence angle of −20.4 degrees, a mean section having a chord length of 1.6302" with an incidence angle of −25.0 degrees, and an intermediate section having a chord length of 1.5644" with an incidence angle of −30.3 degrees. The root section has a chord length of 1.5132" with an incidence angle of −34.8 degrees.

The fourth stage rotating blades 28 include a tip section having a chord length of 0.9599" with an incidence angle of 60.82 degrees, a mean section having a chord length of 0.9772" with an incidence angle of 48.60 degrees, and an intermediate section having a chord length of 1.0606" with an incidence angle of 33.23 degrees. The root section has a chord length of 1.0992 "with an incidence angle of 14.71 degrees. The fourth stage stationary blades 38 include a tip section having a chord length of 1.2272" with an incidence angle of −14.7 degrees, a mean section having a chord length of 1.4494" with an incidence angle of −16.3 degrees, and an intermediate section having a chord length of 1.6290" with an incidence angle of −20.1 degrees. The root section has a chord length of 1.7354" with an incidence angle of −22.0 degrees.

In another exemplary configuration, for example, the compressor 12 may include a first stage including a first rotating disk 20 having sixteen blades 28 with a mean height of 0.9366" and a first stationary disk 22 having ten blades 38 with a mean height of 0.8769." The second stage may include a second rotating disk 20 having seventeen blades 28 with a mean height of 0.8075" and a second stationary disk 22 having fourteen blades 38 with a mean height of 0.7574." A third stage may include a third rotating disk 20 having seventeen blades 28 with a mean height of 0.7028" and a third stationary disk 22 having ten blades 38 with a mean height of 0.6475." A fourth stage may include a fourth rotating disk 20 having nineteen blades 28 with a mean height of 0.5899" and a fourth stationary disk 22 having 21 blades 38 with a mean height of 0.5362."

The first stage rotating blades 28 include a tip section having a chord length of 0.9250" with an incidence angle of 63.79 degrees, a mean section having a chord length of 0.8768" with an incidence angle of 47.34 degrees, and an intermediate section having a chord length of 1.0742" with an incidence angle of 29.79 degrees. The root section has a chord length of 1.1692" with an incidence angle of 37.20 degrees. The first stage stationary blades 38 include a tip section having a chord length of 1.8709" with an incidence angle of −12.4 degrees, a mean section having a chord length of 1.8434" with an incidence angle of −14.9 degrees, and an intermediate section having a chord length of 1.8927" with an incidence angle of −19.6 degrees. The root section has a chord length of 1.9349" with an incidence angle of −18.8 degrees.

The second stage rotating blades 28 include a tip section having a chord length of 0.8657" with an incidence angle of 62.73 degrees, a mean section having a chord length of 0.8441" and an incidence angle of 58.90 degrees, and an intermediate section having a chord length of 0.9855" with an incidence angle of 47.34 degrees. The root section has a chord length of 1.0542" with an incidence angle of 37.30 degrees. The second stage stationary blades 38 include a tip section having a chord length of 1.3857" with an incidence angle of −15.6 degrees, a mean section having a chord length of 1.3457" with an incidence angle of −17.4 degrees, and an intermediate section having a chord length of 1.3477" with an incidence angle of −19.2 degrees. The root section has a chord length of 1.3561" with an incidence angle of −23.5 degrees.

The third stage rotating blades 28 include a tip section having a chord length of 1.0237" with an incidence angle of 61.72 degrees, a mean section having a chord length of 1.0113" with an incidence angle of 55.50 degrees, and an intermediate section having a chord length of 1.1911" with an incidence angle of 42.50 degrees. The root section has a chord length of 1.2152" with an incidence angle of 39.35 degrees. The third stage stationary blades 38 include a tip section having a chord length of 1.7267" with an incidence angle of −20.4 degrees, a mean section having a chord length of 1.5902" with an incidence angle of −20.1 degrees, and an intermediate section having a chord length of 1.5244" with an incidence angle of −25.5 degrees. The root section has a chord length of 1.4712" with an incidence angle of −29.8 degrees.

The fourth stage rotating blades 28 include a tip section having a chord length of 0.9599" with an incidence angle of 60.82 degrees, a mean section having a chord length of 0.9370" with an incidence angle of 57.30 degrees, and an intermediate section having a chord length of 0.9983" with an incidence angle of 47.40 degrees. The root section has a chord length of 1.0370" with an incidence angle of 45.40 degrees. The fourth stage stationary blades 38 include a tip section having a chord length of 1.2272" with an incidence angle of −14.7 degrees, a mean section having a chord length of 1.2174" with an incidence angle of −11.3 degrees, and an intermediate section having a chord length of 1.3684" with an incidence angle of −15.1 degrees. The root section has a chord length of 1.4608" with an incidence angle of −17.1 degrees.

In either of the foregoing exemplary configurations, when the rotating and stationary disks 20, 22 are assembled to the drive shaft 24 and housing 18, the profile of the assembly (i.e., rotating disks 20, stationary disks 22, and drive shaft 24) yields a tapered surface 44 extending from an inlet port 34 of the compressor 12 to an outlet port 36 of the compressor 12. The tapered surface 44 provides the compressor 12 with a compression chamber 46 having a generally conical shape defined generally between the respective tapered surfaces 31, 41 of the hubs 30, 40 and an inner wall of the housing 18.

With reference to FIGS. 5*a* and 5*b*, the tapered surface 44 includes a first portion 44*a* and a second portion 44*b* cooperating to provide the overall shape and contour of surface 44. The first portion 44*a* extends generally from the first rotating disk 20 to the third stationary disk 22 and includes a generally tapered surface having a slope Q. The second surface 44*b* begins generally at the fourth rotating disk 20 and extends generally through the fourth stationary disk 22 and includes a slope S. Slope S of the second surface 44*b* is slightly less than slope Q of the first surface 44*b* to thereby provide the compression chamber with a slightly increased volume at stage 4 than if slope S had continued through stage 4. Therefore, the two surfaces 44*a*, 44*b* cooperate to create surface 44 and provide the compression chamber 46 with a desired volume at each stage.

It should be noted that while the hubs 30, 40 are disclosed as having generally tapered surfaces 31, 41 that each could alternatively include a constant outer surface, thereby yielding a drive shaft 24 having a constant geometry along its length. The drive shaft 24 having a constant cross-section could be used with a conical housing 18 such the shape of the housing 18 provides a desired increase or decrease in compression chamber volume. Alternatively, the drive shaft 24 could be used with a housing 18 having a generally constant cross-section, thereby yielding a compression chamber 46 with a constant cross-section along its length. Furthermore, it should also be noted that while the rotating disks are assembled individually to the drive shaft 24 that the disks 20 could alternately be assembled as a single unit, as will be discussed further below.

Factors such as overall size of the compressor 12, type of fluid, and requisite fluid output dictate the slope of the conical compression chamber 46, and to what extent the compression chamber 46 should decrease in volume in moving from the inlet port 34 to the outlet port 36. In this manner, the shape of the compression chamber 46 largely depends on system requirements and may be adapted to accommodate different compressor sizes and applications.

With continuing reference to FIGS. 2 and 5*a*-5*b*, the rotating and stationary disks 20, 22 are assembled onto the drive shaft 24 in an alternating pattern to provide the compressor 12 with a requisite output pressure and velocity. The compression machine 10 may include up to eleven stages (i.e., rotating and stationary disks 20, 22) depending on the output requirements of the compressor 12. For exemplary purposes, a four stage compressor system is shown in FIG. 2 incorporating four rotating disks 20 and four stationary disks 22. The disks 20, 22 alternate such that each stationary disk 22 is separated by a rotating disk 20 and each rotating disk 20 is separated by a stationary disk 22.

In operation, fluid is introduced to the compression chamber 46 at the inlet port 34 via a bell mouth path 100 and is energized by a first rotating disk 20 via blades 28. Depending on the particular application, a misting device 51 may be used near the inlet port 34 to mix the incoming air with a mist, for example, to cool the exhaust or with fuel to boost performance of the machine 10. The misting device 51 may include a nozzle 53 that injects a mist of water or coolant into the air stream prior to the air encountering the compression chamber 46. The mist helps cool the internal components of the compression machine 10 and helps control the temperature of the air during compression and at the outlet port 36. The mist is typically only used in high-pressure application such as in a race car when internal components of the compression machine 10 become heated, thereby causes the air to be heated at the outlet port 36.

As the fluid is energized, it moves along the compression chamber 46 from the inlet port 34 to the outlet port 36 encountering each of the rotating and stationary disks 20, 22 along the way. Once the fluid is energized by the first rotating disk 20, the fluid encounters a first stationary disk 22, thereby causing the fluid to change conditions and travel toward the rotating disk 20 with a new direction. In so doing, the energy of the fluid between the first rotating disk 20 and first stationary disk 22 increases.

Once the pressure of the fluid reaches a predetermined threshold limit, the fluid will traverse the blades 38 of the first stationary disk 22 and encounter a second rotating disk 20. The above process is repeated between the respective rotating and stationary disks 20, 22 until the fluid has traveled the length of the compression chamber 46 and has reached the outlet port 36. At this point, the fluid exits the compression chamber 46 at a higher pressure and velocity and enters the diffuser 16 to tailor the flow, pressure, and velocity of the fluid to the particular application.

The rotating and stationary disks 20, 22 compress and move the fluid along the compression chamber 46 due to the shape and the orientation of the blades 28, 38. The blades 28 facilitate fluid flow through the compression chamber, 46 and are designed to ideally provide a constant and undisturbed flow through the compressor 12. If the blades 28 create a highly turbulent flow in moving the fluid through the compression chamber 46, energy is lost and the efficiency of the compressor 12 suffers.

The blades 38 of stationary disks 22 have a similar construction to that of the blades 28 of rotating disks 20 to continuously advance the fluid through the compression chamber 46. The stationary disks 22 receive the fluid from the rotating disks 20 and further increase the energy of the fluid, as previously discussed. The blades 38 also maintain the generally undisturbed flow received from the rotating disks to reduce energy loss and improve the overall efficiency of the compressor 12.

The compressor 12 may also include a regulation mechanism 48 that directs and regulates the pressurized fluid in accordance with system requirements and a filter 50 that filters impurities from incoming fluid. The regulation mechanism 48 measures one or more fluid variables (i.e., flow, pressure, temperature, etc.) to determine current operating conditions of the compressor 12 and to adjust the inlet or outlet ports 34, 36 accordingly if the compressor 12 is not performing within desired operating conditions. The regulation mechanism 48 is located at the inlet and outlet ports 34, 36 and may also be in communication with an external system such as a vehicle controller to regulate the amount of fluid entering the compressor 12 and the velocity, pressure, and volume of fluid exiting the compressor 12 at the outlet port 36.

Another regulation mechanism 49 may include a set of adjustable inlet guide vanes or blades 59 attached to the compressor structure before the first stage of the compressor 12. The guide blades 59 may be rotated along an axis of each blade 59 with a linkage control 61 that positions each blade 59 at a defined angle at the same time. The blades 59 may be equally spaced and may include triangular and aerodynamically shaped blades. The position of the blades 59 directs the airflow while its incidence angle to the first stage of rotary blades 20 determines the general performance curves of the compressor 12.

The transmission 14 receives a rotational force from an external system and applies the rotational force to the drive shaft 24 to thereby drive the compressor 12 at a predetermined speed. With particular reference to FIGS. 2 and 6-8, the transmission 14 is shown to include a housing 52, a combined pulley assembly 54, and a compressor pulley 56. The combined pulley assembly 54 and compressor pulley 56 are rotatably supported within the housing 52 and cooperate to convert an input rotational speed received by the transmission 14 into a rotational speed capable of producing a desired fluid flow at the outlet of the compressor 12, as will be discussed further below.

While a belt-driven transmission 14 is disclosed, the compressor 12 may be used with any transmission such as, but not limited to, a continuously variable transmission and may alternatively be directly driven by an output of an engine or electric motor. The compressor 12 may be rotatably driven by an electric motor to allow the compressor 12 to be used only when needed. The electric motor may directly drive the compressor 12 or may drive the compressor 12 via the transmission 14.

The combined pulley assembly 54 includes an input pulley 58, an output pulley 60, and a shaft 62. The input pulley 58 is disposed adjacent to, and is fixed for rotation with, the output pulley 60 and includes a smaller diameter than the output pulley 60. Each of the pulleys 58, 60 includes a central aperture 64 for rotatable attachment to the shaft 62. The apertures 64 are journally supported on the shaft 62 by a series of bearings 65 to allow the pulleys 58, 60 to freely rotate about the shaft 62. The bearings 65, in addition to providing the pulleys 58, 60 with the ability to freely rotate about the shaft 62, also provide for adjustment of the pulleys 58, 60 relative to the housing 52 and are therefore "floating" bearings. Adjustment of the pulleys 58, 60 relative to the housing 52 provides the transmission 14 with the ability to account for slack both between the pulleys 56, 58, 60 and between the input pulley 58 and an external system. The input and output pulleys 58, 60 are rotatably supported within the housing 52 by the shaft 62 and are free to rotate relative to the housing 52.

With continued reference to FIGS. 2 and 6-8, a compressor transmission member 66 is shown extending between the output pulley 60 of the combined pulley assembly 54 and the compressor pulley 56 such that a rotational force applied to the output pulley 60 is concurrently applied to the compressor pulley 56. The compressor transmission member 66 extends around an outer diameter of the output pulley 60 such that rotation of the output pulley 60 causes concurrent rotation of the transmission member 66. The transmission member 66 also extends around an outer diameter of the compressor pulley 56 such that rotation of the transmission member 66 causes concurrent rotation of the compressor pulley 56. It should be noted that the transmission member 66 may be of any construction suitable for transferring a rotational force from the output pulley 60 to the compressor pulley 56, including a rubber cog belt or chain belt or a set of gears.

The compressor pulley 56 is fixedly attached to the drive shaft 24 of the compressor 12 such that rotation of the compressor pulley 56 causes concurrent rotation of the drive shaft 24. When the transmission member 66 is rotated via rotation of the input and output pulleys 58, 60, the compressor pulley 56 and drive shaft 24 are also rotated. The compressor pulley 56 is rotated at a higher speed when compared to the input pulley 58 due to the diameter ratio between the input pulley 58, the output pulley 60, and the compressor pulley 56.

The circumference of the output pulley 60, upon which the transmission member 66 rotates, is greater than the circumference of the input pulley 58 due to the larger diameter of the output pulley 60. Therefore, when the output pulley 60 is rotated, the transmission member 66 is rotated over a greater distance than if directly attached to the input pulley 58, as the circumference of the input pulley 58 is smaller than the circumference of the output pulley 60. The distance the transmission member 66 travels for a single rotation of the input pulley 58, causes the compressor pulley 56 to rotate at a higher speed when compared to the rotational speed of the input pulley 58, due to the relationship between the circumference of the compressor pulley 56 and the circumference of the output pulley 60. Specifically, the compressor pulley 56 includes a smaller diameter, and thus, a smaller circumference than the output pulley 60. Therefore, a single rotation of the output pulley 60 causes multiple rotations of the compressor pulley 56, thereby causing the compressor pulley 56 to rotate at a higher speed than either of the input and output pulleys 58, 60.

Figure 1A:
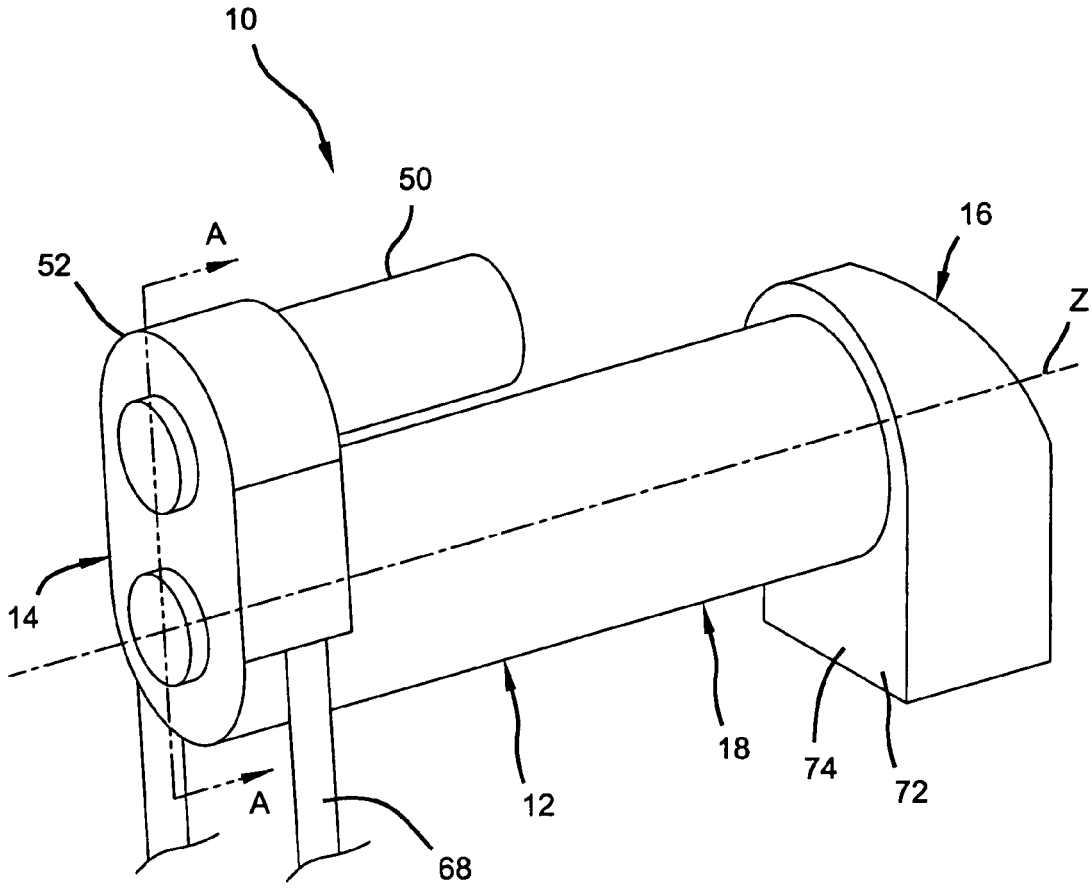
FIG. 1*a* is a perspective view of a compression machine in accordance with the present teachings.
Figure 1B:
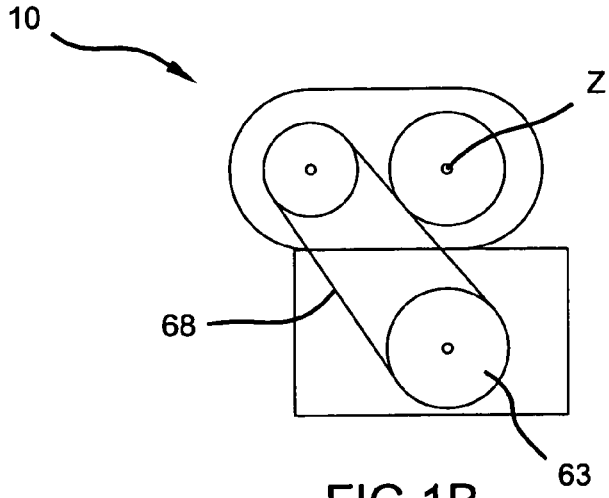
FIG. 1*b* is a perspective view of the compression machine of FIG. 1*a* rotated 90 degrees about axis Z.

In operation, the input pulley 58 receives a rotational force from an external system via an input transmission member 68 and is rotated about shaft 62 at substantially the same tangential speed as the input transmission member 68. Rotation of the input pulley 58 at the same speed as the input transmission member 68 causes the output pulley 60 to rotate therewith. The output pulley 60 rotates at the same speed as the input pulley 58, but is capable of rotating the compressor pulley 56 at a higher speed due to the difference in diameter between the input and output pulleys 58, 60, as previously discussed. Increasing the rotational speed of the drive shaft 24 improves the performance of the compressor 12 by providing the compressor 12 with the ability more quickly draw fluid into the compression chamber 46 and thus produce a greater volume of pressurized fluid over a shorter period of time. While the compression machine 10 is shown in FIG. 1*a* in a generally upright position, it should be understood that the compression machine 10 could be rotated about axis Z to accommodate a particular application. FIG. 1*b* shows the compression machine 10 rotated about axis Z with the input transmission member 68 being received generally 90° from the position shown in FIG. 1*a*. It should be noted that the shaft 24 of the machine 10 may be located at any angle, including a vertical configuration.

In addition to the foregoing, the transmission 14 may also include a clutch assembly 70 disposed generally between the combined pulley assembly 54 and the drive shaft 24 to selectively restrict rotation of disks 20, as best shown in FIG. 2. The clutch assembly 70 disconnects the drive shaft 24 from driving the rotating disks 20 to reduce power consumed by the compression machine 10 during times when a pressurized fluid flow is unnecessary (i.e., in a vehicle application, when the vehicle is at idle).

Under such conditions, the rotating disks are free to rotate by the circulation of fluid inside the compression chamber 46, resulting in decreased internal head losses. When a pressurized flow is required, the clutch assembly 70 engages the drive shaft 24 to thereby transfer power to the rotating disks 20 and provide a pressurized fluid flow once again. While the clutch 70 is described as being associated with drive shaft 24, it should be understood that the clutch 70 could alternatively be associated with shaft 62 or with an engine pulley 63 to thereby restrict rotation of the disks 20. The clutch 70 is particularly advantageous for use with a low-horsepower compressor 12 and functions best when positioned in close proximity to the engine pulley 63.

When the transmission 14 is driving the compressor 12 (i.e., when the clutch assembly 70 is engaged) the fluid pressure accumulated within the compression chamber 46 is released through the outlet port 36 and into the diffuser 16. The diffuser 16 receives the pressurized fluid having a predetermined pressure and velocity and serves to tailor the fluid flow such that exiting fluid from the compression machine 10 is at a requisite pressure and velocity.

With reference to FIG. 2, the diffuser 16 is disposed adjacent to the outlet port 36 and includes a housing 72 and an outlet 74. The diffuser 16 receives the pressurized fluid from the compression chamber 46 and partially converts the velocity head into a pressure head, based on the requirements of the compression machine 10. The percentage of the velocity head converted into a pressure head depends on the design of the diffuser 16 for the particular application to which the compression machine 10 is tied. For example, if the compression machine 10 is required to supply a high velocity pressurized fluid, the diffuser 16 will not significantly reduce the velocity of the pressurized fluid exiting the outlet port 36 of compression chamber 46. On the other hand, if the compression machine 10 is required to supply a high pressure, low velocity fluid flow, more of the velocity head will be converted into a pressure head by the diffuser 16.

Figure 1C:
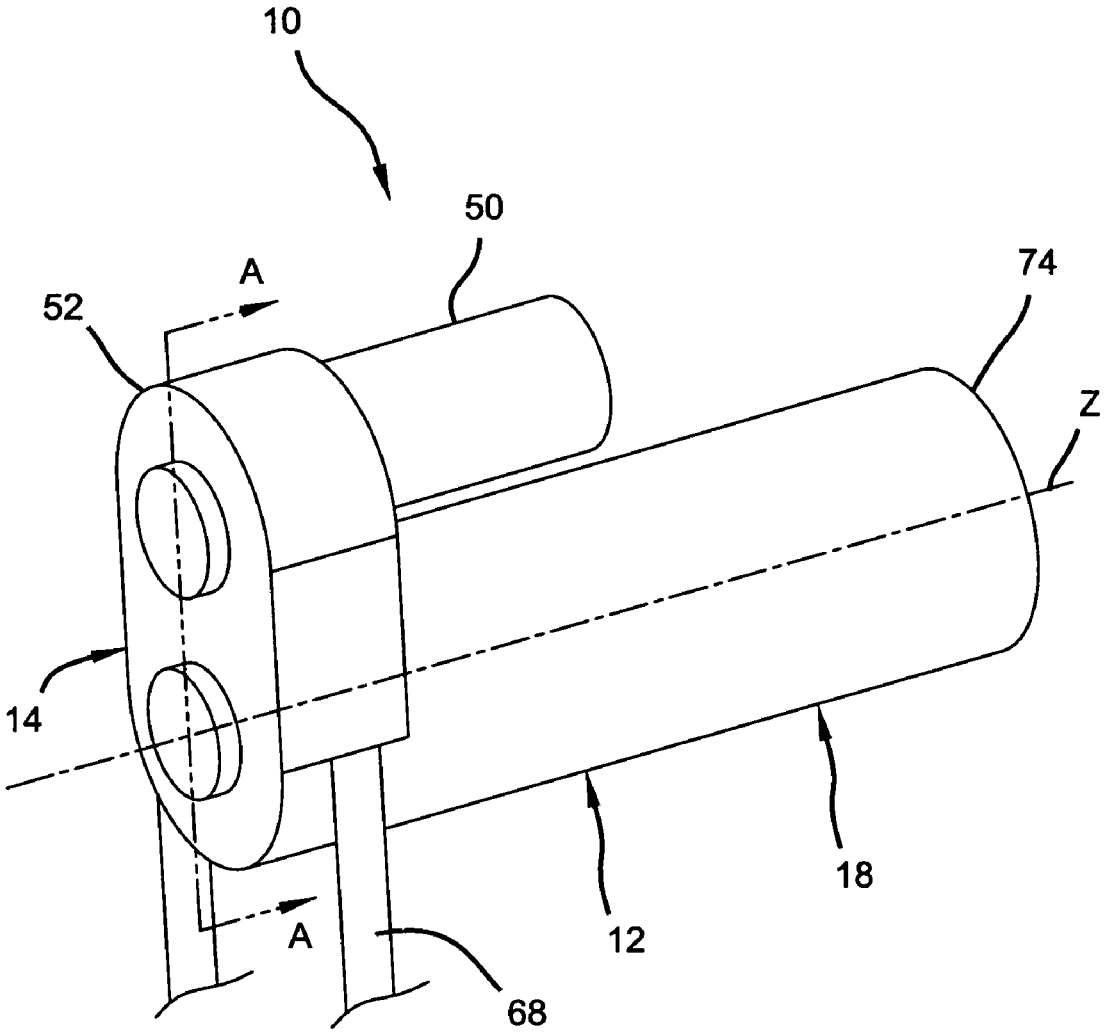
FIG. 1*c* is a perspective view of the compression machine of FIG. 1*a* with a diffuser removed.

The diffuser 16 can convert different percentages of the velocity head into a pressure head, based on system conditions and requirements. Therefore, the amount of fluid altered by the diffuser 16 largely depends on the requirements of the system to which the compression machine 10 is tied. As can be appreciated, certain applications may not require the compression machine 10 to include a diffuser 16. In such applications, the diffuser 16 is simply removed from the housing 18 such that the output 74 of the compression machine 10 simply exits directly from the housing 18, as shown in FIG. 1*c*.

Figure 10:
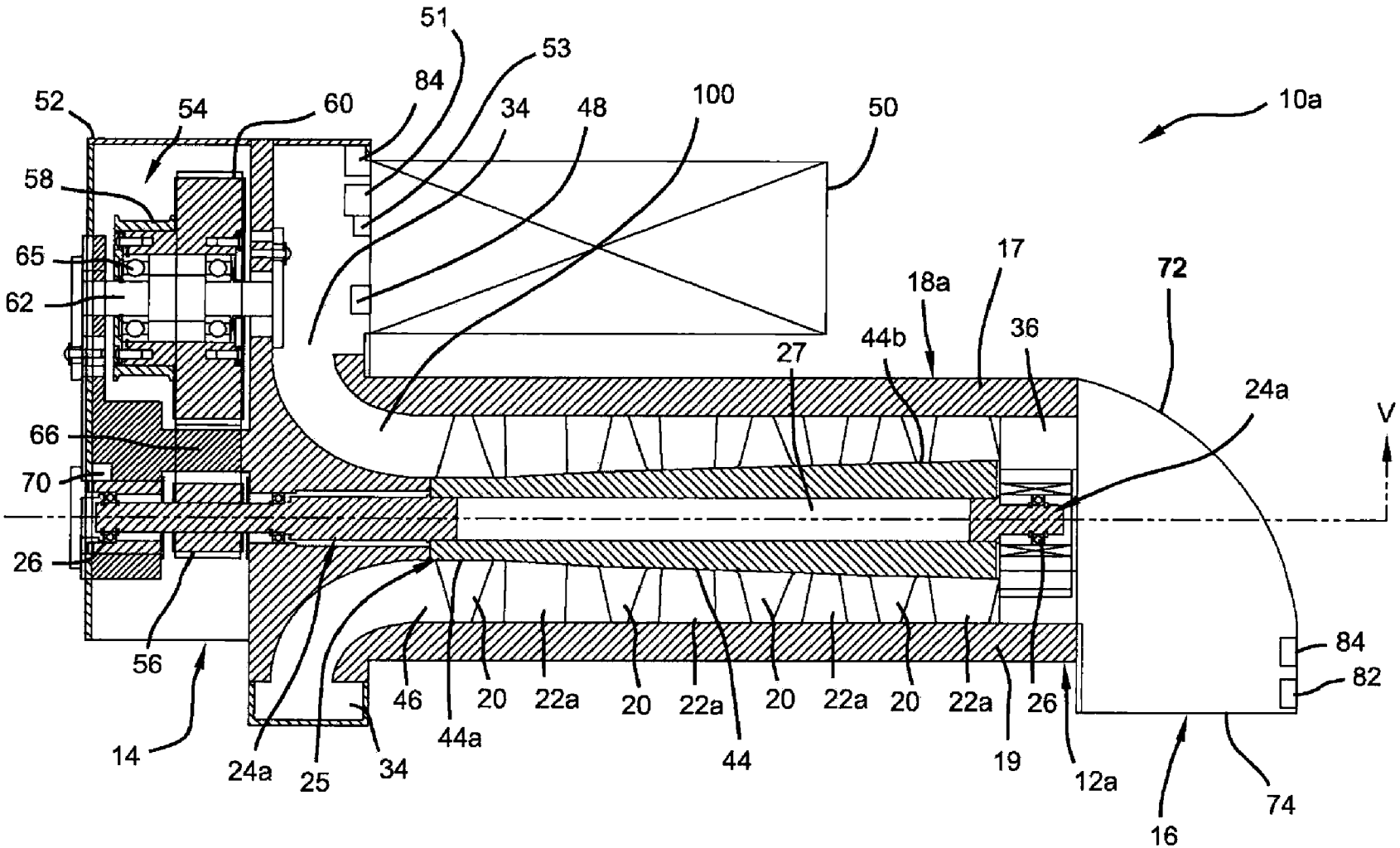
FIG. 10 is a cross-sectional view of a compression machine in accordance with the present teachings.
Figure 11B:
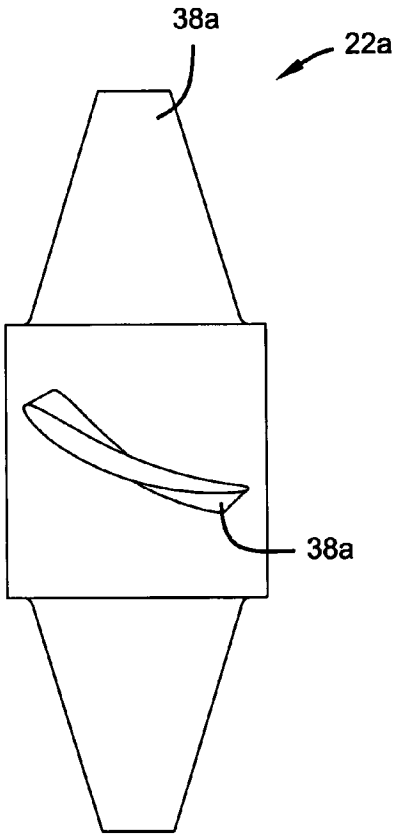
FIG. 11*b* is a side view of the rotary disk of FIG. 12*a;*
Figure 11A:
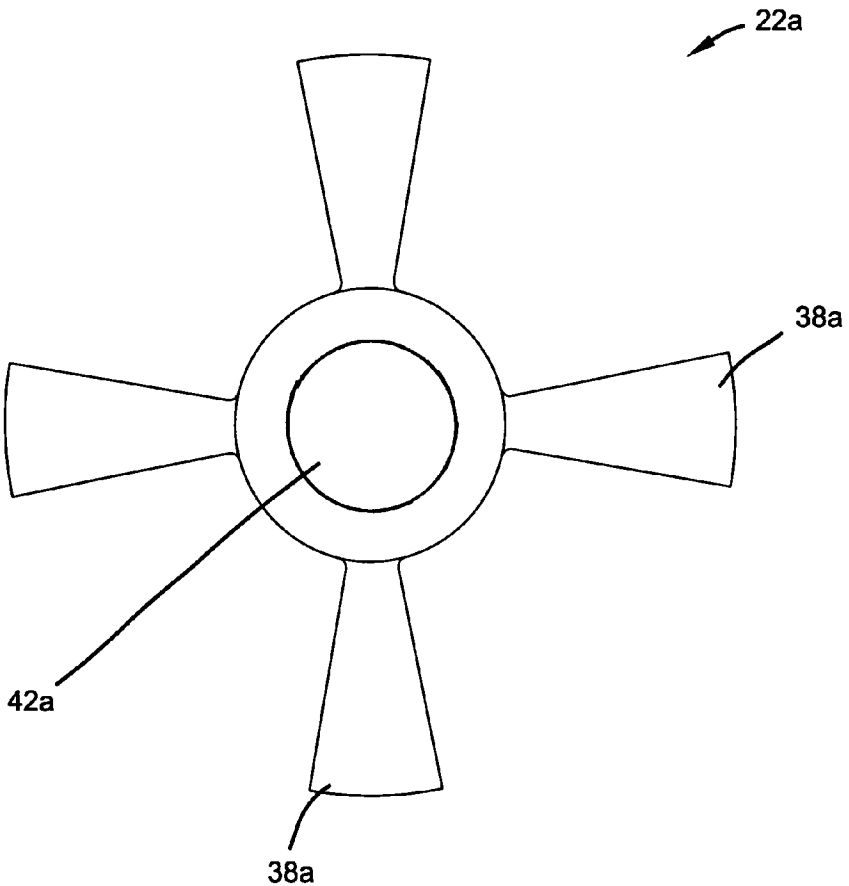
FIG. 11*a* is a front view of a rotary disk of the compression machine of FIG. 10 according to the present teachings.

With particular reference to FIGS. 10, 11*a*, and 11*b*, another compression machine 10*a* is shown having a compressor 12*a*, a transmission 14, and a diffuser 16. In view of the substantial similarity in structure and function of the components associated with the compression machine 10 with respect to the compression machine 10*a* like reference numerals are used hereinafter and in the drawings to identify like components while like reference numerals containing letter extensions are used to identify those components that have been modified.

The compressor 12*a* is shown including an impeller 25 having blades 28 formed integrally therewith. The impeller 25 is a substantially elongate, hollow member and is rotatably supported by the housing 18*a* via drive shaft sections 24*a* and bearings 26. The drive shaft sections 24*a* are fixedly attached to the impeller 25 at opposing ends such that a cavity 27 is formed therebetween. The drive shafts 24*a* are attached to the impeller 25 by a suitable process such as welding, fastening (i.e., bolts, etc.), or press-filling such that the drive shafts 24*a* are fixed for rotation with the impeller 25. The impeller 25 includes a tapered surface 44 extending along its length, thereby providing the compression chamber 46 with a substantially conical shape defined generally between the tapered surface 44 and an inner wall of the housing 18*a*.

The housing 18*a* includes a two-part construction having two separable halves 17, 19 separated along line V-V of FIG. 10. Each of the halves 17, 19 includes a half of a stationary disk 22*a* integrally formed therewith such that when the housing halves 17, 19 are assembled (i.e., along line V-V), a generally circular stationary disk 22*a* is formed. The halves 17, 19 may be assembled together using any suitable method such as mechanical fasteners (i.e., a nut and bolt construction). Each half may be injection molded such that the stationary disks 22*a* are formed integrally with an outer wall of the housing 18*a*. Furthermore, each half 17, 19 may be formed together such that a living hinge extends along one side of the housing 18*a*, generally along line V-V of FIG. 10. Such a construction allows the halves 17, 19 to be formed as a single piece and then folded along the living hinge to close the housing 18*a*.

Figure 12:
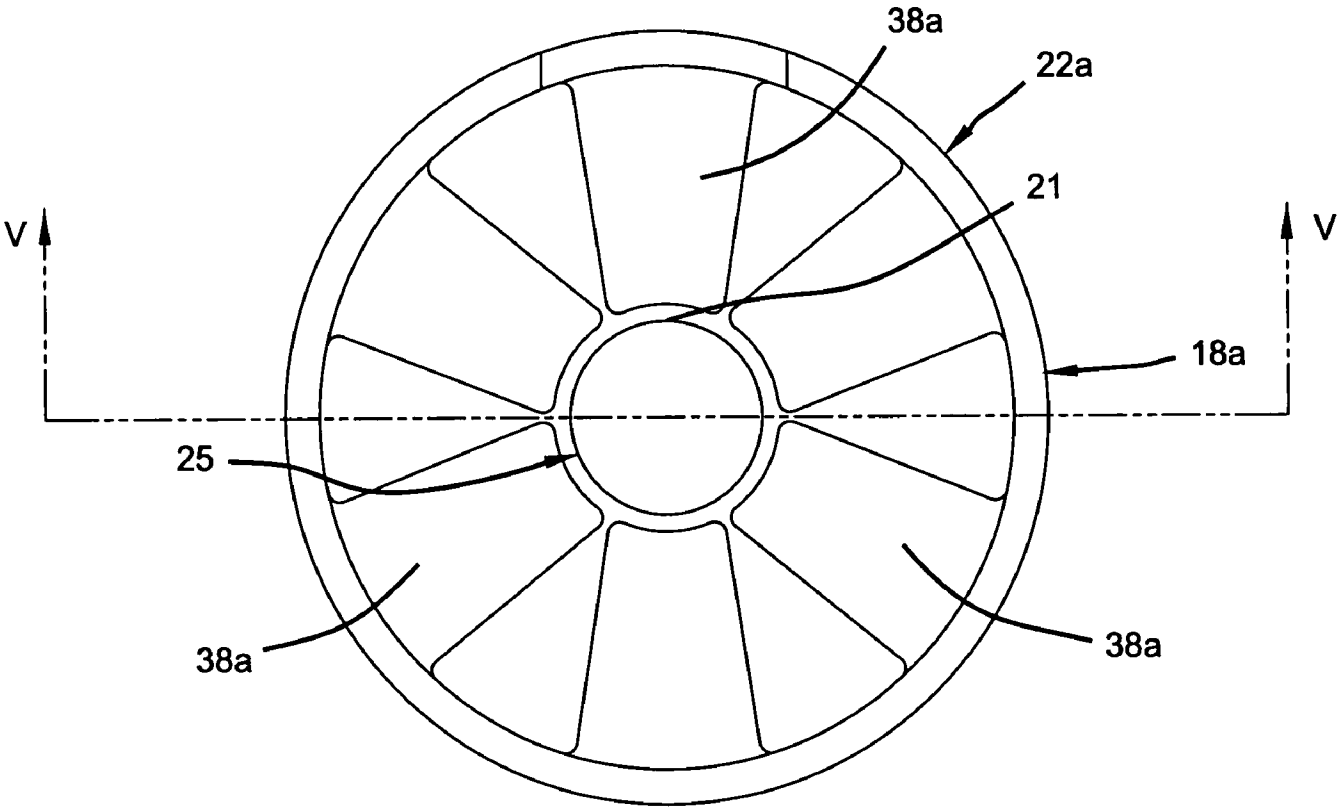
FIG. 12 is a side view of a stationary disk.

With reference to FIG. 12, the stationary disk 22*a* is shown including a plurality of blades 38*a* and a central aperture 42*a*. The blades 38*a* are fixedly attached to an inner wall of the housing 18*a* while the central aperture 42*a*generally surrounds a portion of the impeller 25. The aperture 42*a* provides clearance 21 between the disk 22*a* and the impeller 25, thereby allowing the impeller 25 to rotate relative to the disk 22*a*. When the impeller 25 is rotating, and thus actively moving fluid through the compression chamber 46, the stationary disks 22*a* are fixed to increase the pressure of the fluid passing therethrough.

Figure 13A:
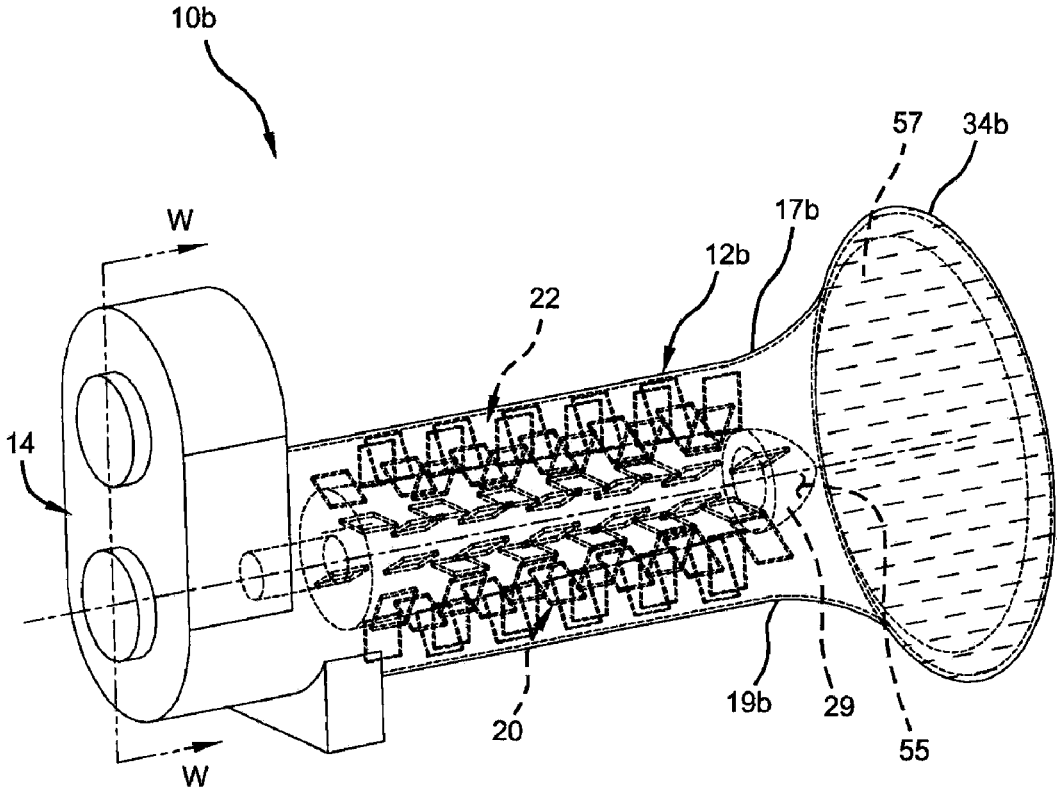
FIG. 13*a* is a perspective view of a compression machine in accordance with the present teachings.
Figure 13B:
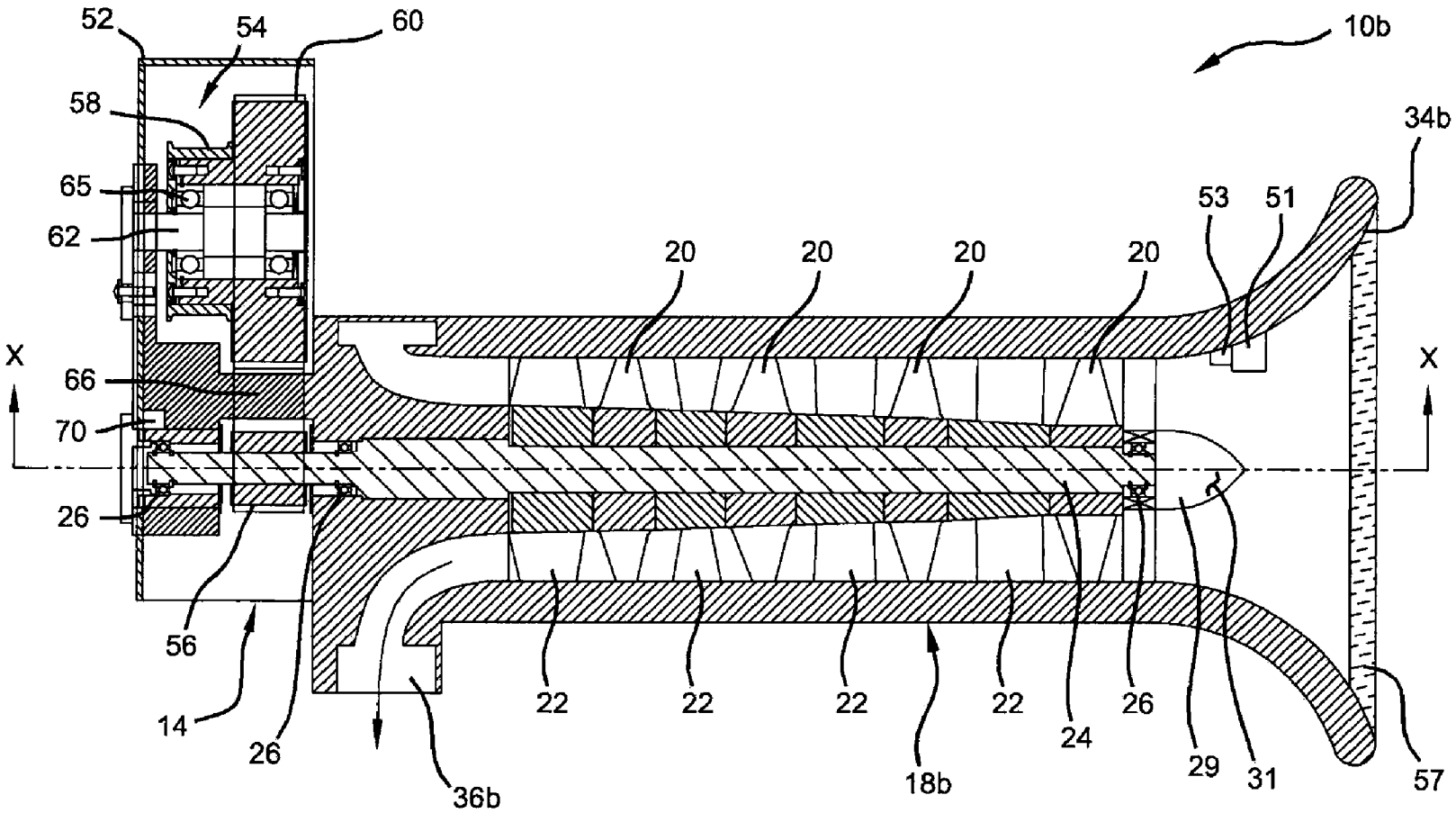
FIG. 13*b* is a cross-sectional view of the compression machine of FIG. 13*a* taken along line W-W.

With particular reference to FIGS. 13*a* and 13*b*, another compression machine 10*b* is shown having a compressor 12*b* and a transmission 14. In view of the substantial similarity in structure and function of the components associated with the compression machine 10 with respect to the compression machine 10*b* like reference numerals are used hereinafter and in the drawings to identify like components while like reference numerals containing letter extensions are used to identify those components that have been modified.

With reference to FIG. 13*a*, the compressor 12*b* is shown including a series of rotating disks 20 and stationary disks 22 that cooperate to define a generally tapered surface 44. The tapered surface 44 extends from an inlet port 34*b* having a bell mouth to an outlet port 36*b*. A cone 29 extends into the inlet port 34*b* and includes a tapered leading end 55 that facilitates air entering the compressor 12*b*. The tapered leading end 55 cooperates with the overall shape of the bell mouth inlet port 34*b* to draw air into the compression machine 10*b*. The bell mouth is not required to be directly attached to the machine 10*b*. The bell mouth may be fluidly coupled to the inlet port 34*b* by a duct located at a distance from the inlet port 34*b*. The duct allows the machine 10*b* to be remotely located from the bell mouth and may be flexible to accommodate packaging of the machine 10*b* within a device, such as an automotive engine compartment. In addition, the bell mouth may include a filter 57 to purify the incoming air.

The compression machine 10*b* includes a housing 18*b* having a two-part construction having two separable halves 17*b*, 19*b* separated along line X-X of FIG. 13*b*. Each of the halves 17*b*, 19*b* includes a half of a stationary disk 22 integrally formed therewith such that when the housing halves 17*b*, 19*b* are assembled (i.e., along line X-X), a generally circular stationary disk 22 is formed. Each half may be injection molded such that the stationary disks 22 are formed integrally with an outer wall of the housing 18*b*. Furthermore, each half 17*b*, 19*b* may be formed together such that a living hinge extends along one side of the housing 18*b*, generally along line X-X of FIG. 13*b*. Such a construction allows the halves 17*b*, 19*b* to be formed as a single piece and then folded along the living hinge to close the housing 18*b*.

Figure 14A:
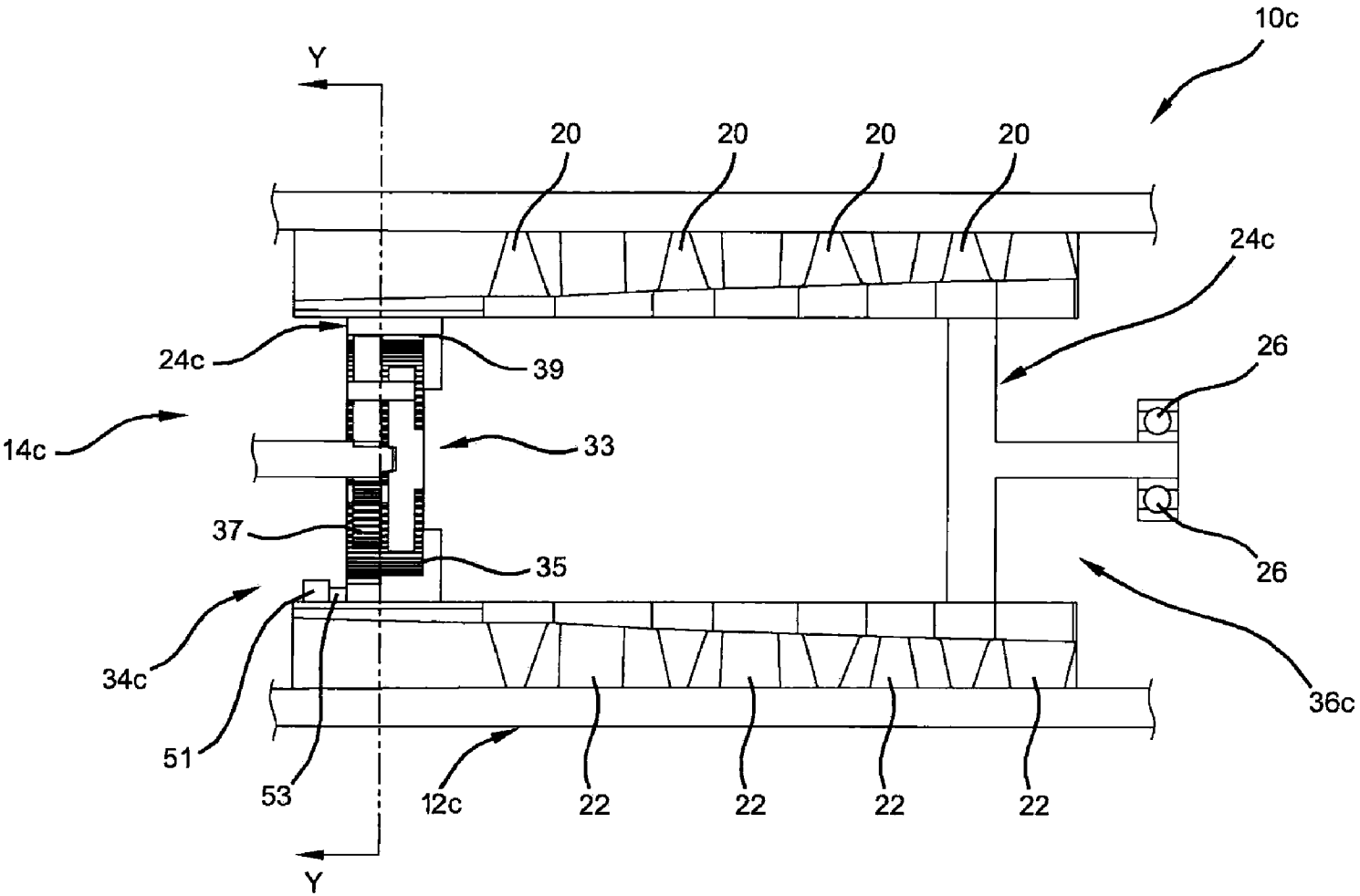
FIG. 14*a* is a cross-sectional view of a compression machine in accordance with the present teachings.
Figure 14B:
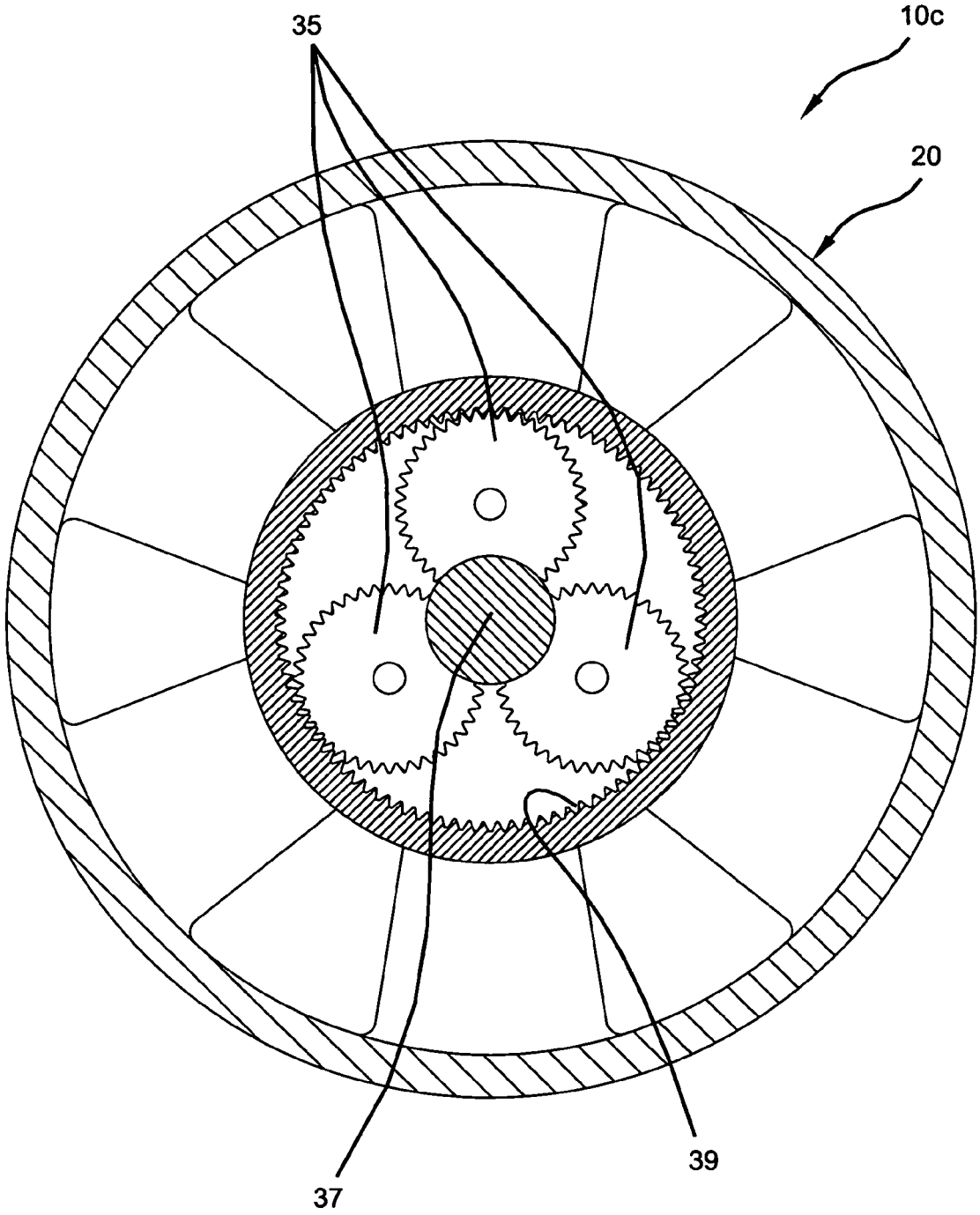
FIG. 14*b* is a cross-sectional view of the compression machine of FIG. 14*b* taken along line Y-Y.

With particular reference to FIGS. 14*a* and 14*b*, another compression machine 10*c* is shown having a compressor 12*c* and a transmission 14*c*. In view of the substantial similarity in structure and function of the components associated with the compression machine 10 with respect to the compression machine 10*c* like reference numerals are used hereinafter and in the drawings to identify like components while like reference numerals containing letter extensions are used to identify those components that have been modified.

With reference to FIG. 14*a*, the compressor 12*c* is shown including a series of rotating disks 20 and stationary disks 22 that cooperate to define a generally tapered surface 44. The transmission 14*c* includes a planetary gear set 33 having a series of planetary gears 35 and a sun gear 37. The sun gear 37 is rotated by an external device such as an automotive engine or may receive a rotational force from an electric motor. In either event, when the sun gear 37 is rotated, the planetary gears 35 are caused to rotate about the sun gear 37. The planetary gears 35 are also in meshed engagement with internal teeth 39 formed on an inner diameter of a drive shaft 24*c*. When the planetary gears 35 are rotated by the sun gear 37, engagement between the planetary gears 35 and the teeth 39 of the drive shaft 24*c* causes the drive shaft 24*c* to similarly rotate. It should be noted that a similar gear set configuration may be used with a continuously variable transmission device. The advantage of such a construction is the possibility of releasing the response of the supercharger from the speed of an engine, thereby simplifying regulation of the machine 10*c* and increasing efficiency.

Rotation of the drive shaft 24*c* causes the rotating disks 20 to rotate and draw air into an inlet port 34*c*. Once the air is drawn into the inlet port 34*c*, the air encounters the rotating disks 20 and stationary disks 22 and is compressed prior to being expelled at an outlet port 36*c*.

While the transmission 14*c* is described as being disposed within the inlet port 34*c* of the compression machine 10*c*, the transmission 14*c* may alternatively be positioned at a high-pressure end of the compression machine 10*c*. For example, the transmission 14*c* may be positioned near the outlet port 36*c* of the compression machine 10*c* such that the compression machine 10*c* is driven at the outlet port 36*c*. Under such a configuration, air is still drawn into the compressor 12*c* at the inlet port 34*c*, but rotation of the drive shaft 24*c* is accomplished by applying a rotational force at the outlet port 36*c* (i.e., via transmission 14*c*).

Figure 15:
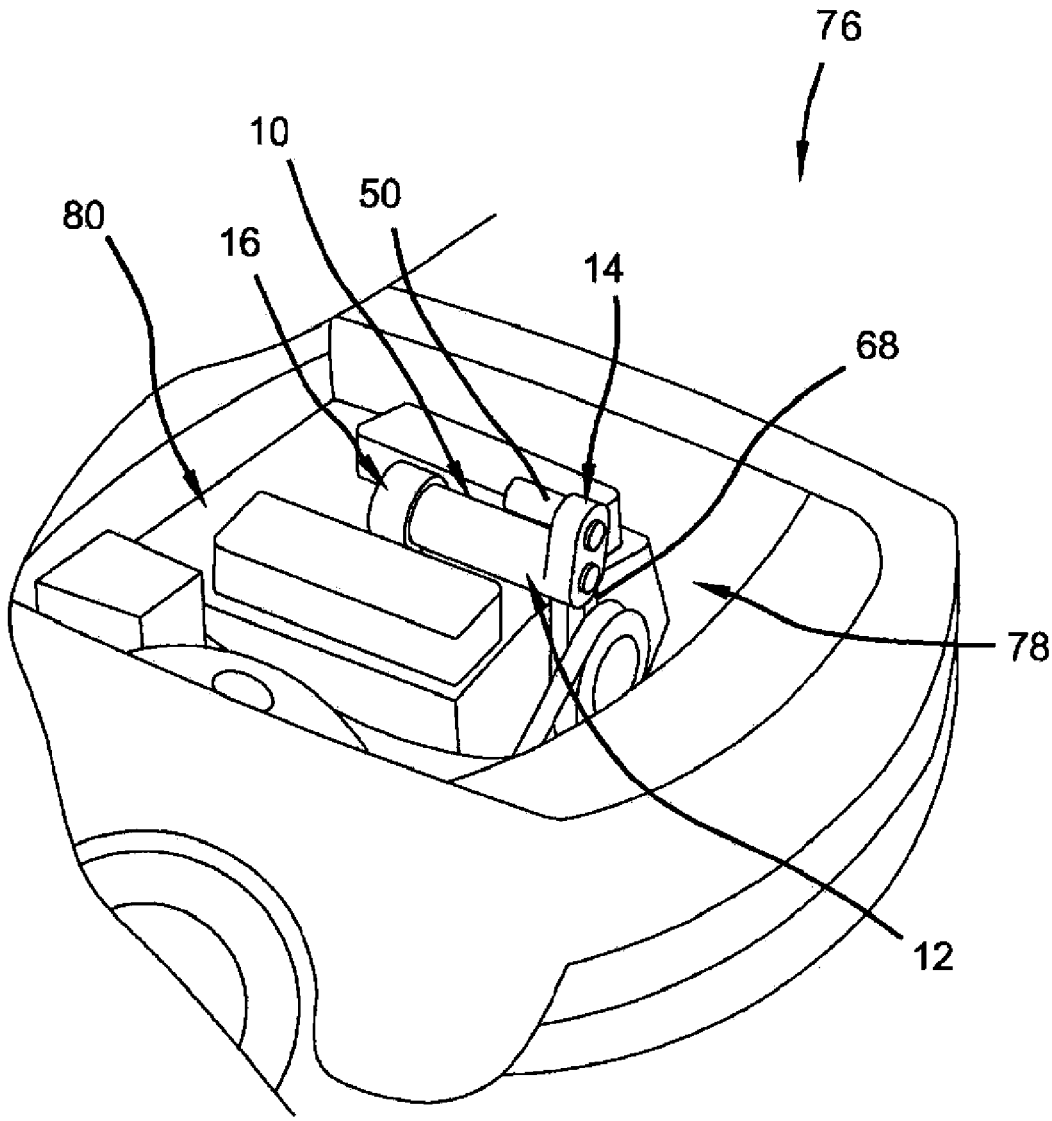
FIG. 15 is a perspective view of a vehicle having an engine compartment housing an engine and a supercharger in accordance with the present teachings.

With particular reference to FIGS. 2, 10, and 13, operation of the compression machine 10 will be described in detail. It should be noted that compression machine 10 works in substantially the same manner as compression machines 10*a*, 10*b*, and 10*c*. Therefore, a detailed description of the operation of compression machines 10*a*, 10*b*, and 10*c* is foregone. FIG. 15 depicts the compression machine 10 incorporated into a vehicle 76. The compression machine 10 is disposed within an engine compartment 78 of the vehicle 76 and is tied to, and driven by, an engine 80. In this manner, the compression machine 10 is being used as a "supercharger" to provide a compressed air stream to the engine 80.

The compression machine 10 is positioned within the engine compartment 78 such that air can readily and easily be drawn into the compression chamber 46 via filter 50 and inlet port 34. The compression machine 10 may be positioned within the engine compartment 78 such that the inlet 50 faces a high pressure area or the front portion of the vehicle 76 to take advantage of the pressurized air caused by forward movement of the vehicle 76. Such pressurized air provides the compression machine 10 with a "ram" effect and helps increase the efficiency of the compression machine 10 by reducing the amount of energy required by the compression machine 10 to fully compress the air.

The compression machine 10 is driven by the engine 80 based on a relationship between the input transmission member 68 and the input pulley 58 of the transmission 14. The input transmission member 68 is connected at one end to the input pulley 58 of the transmission 14 and at a second end to an output of the engine 80 such as a crankshaft (not shown). Therefore, as the engine 80 turns the crankshaft, the input transmission member 68 rotates and causes concurrent rotation of the input pulley 58.

Rotation of the input pulley 58 causes concurrent rotation of the output pulley 60 as the input pulley 58 is fixed for rotation with the output pulley 60, as previously discussed. Assuming the clutch assembly 70 is engaged, rotation of the output pulley 60 causes concurrent rotation of the drive shaft 24 via compressor pulley 56 and ultimately rotation of disks 20. The compressor pulley 56 rotates at a higher speed than either of the input or output pulleys 58, 60 due to the relative difference in diameter between each of the pulleys 56, 58, 60.

Rotation of the drive shaft 24 causes concurrent rotation of each of the rotating disks 20, thereby causing air to be drawn into the compression chamber 46 and compressed. The drawn air first passes through the filter 50 to remove any impurities prior to reaching the compression chamber 46. Once the air passes through the filter 50, the air is received by the inlet port 34 prior to being drawn into the first rotating disk 20 (i.e., stage one). As previously discussed, the rotating disk draws the air from the inlet port 34 and compresses the air through interaction with blades 28.

The blades 28 force the air from the air inlet port 34 and towards the outlet port 36 and therefore into the stationary disk 22 of stage 1. Upon encountering the stationary disk 22, the direction of the air is changed to enter with a minimum shock generally towards the next rotating disk 20 due to the shape and position of the blades 38 of the stationary disk 22, thereby raising the energy and pressure of the air. Once the air disposed between the rotating disk 20 and the stationary disk 22 reaches a predetermined pressure, the air traverses the blades 38 of the stationary disk 22 and passes on to the next stage.

In order for the air to be fully compressed and exit the compression chamber 46 at an appropriate pressure and velocity, the air must encounter each of the stages (i.e., one though four). Therefore, once the air leaves the first stage, it will encounter the second, third, and fourth stages, thereby compressing the air stream even further. As can be appreciated, the configuration and overall number of rotating and stationary disks 20, 22 may be altered to provide the compression machine 10 with a different output pressure or velocity, based largely on the operating requirements of the engine 80.

Once the air has traversed the stationary disk 22 at stage four, the compressed air exits the compression chamber 46 at the outlet port 36. Upon leaving the outlet port 36, the compressed air is received by the housing 72 of diffuser 16. The diffuser 16 converts the energized air into the proper speed and pressure for use by the engine 80 such that engine requirements are sufficiently met. The diffuser housing 72 matingly engages cylinders (not shown) of the engine 80 such that the outlet 74 is in fluid communication with each cylinder. In this manner, once the air is manipulated by the diffuser 16, the air exits the compression machine 10 via outlet 74 and is received by each cylinder of the engine 80. Before or once in the cylinder, the compressed air is mixed with a fuel mixture for combustion to thereby increase the power output of the engine 80.

In the event that a clutch is used and the engine 80 does not require additional output (i.e., such as at idle) the compression machine 10 may restrict the amount of air drawn into the compression chamber 46 by disengaging the drive shaft 24 via clutch 70. Specifically, when the engine 80 is in a state that does not require an air "boost" from the compression machine 10, the clutch 70 will disengage the drive shaft 24 from rotating disks 20, thereby preventing the compression machine 10 from delivering a compressed air stream to the engine 80. Disconnecting the drive shaft 24 from the rotating disks 20 when air compression is unnecessary improves the overall efficiency of the engine 80 as energy is not wasted on rotating the drive shaft 24 when an air boost is not required.

In operation with a clutch 70, an engine controller (not shown) senses an operating state of the engine 80 and relays the information to the compression machine 10. If the operating state is such that the engine 80 does not require an air boost, the clutch 70 will disengage the drive shaft 24 from the rotating disks 20, thereby improving the efficiency of the engine 80 as energy is not unnecessarily used to rotate the drive shaft 24 and disks 20. When the clutch 70 is disengaged, air may still enter the combustion chamber 46 via filter 50 and rotate the disks 20. Under such conditions, the disks 20 are not rotated under power of the engine 80 and transmission 14, but rather, are rotated at a velocity based on the position of the compression machine 10 and the speed of the vehicle 76, as will be discussed further below.

FIG. 15 depicts the compression machine 10 disposed in the engine compartment 78 of the vehicle 76 such that the compression machine 10 is driven by the engine 80. The outlet port 36 and outlet 74 are fluidly coupled to the cylinders of the engine 80, as previously discussed. A negative pressure is experienced by the compression chamber 46 even when the drive shaft 24 is restricted from rotating disks 20 due to disengagement of clutch 70. Therefore, the rotation of disks 20 when the drive shaft 24 is disconnected by the clutch 70 is determined as a function of the air requirements as drawn by the engine 80.

If the engine controller senses that an air boost is required (i.e., due to acceleration, etc.) then a signal is sent to the compression machine 10 to engage the clutch 70 to thereby rotate the disks 20 and provide the engine 80 with compressed air.

When the clutch 70 is engaged, the regulation mechanism 48 ensures that the engine 80 receives the requisite amount of compressed air at each cylinder. Air is induced through filter 50 and carried through the inlet port 34 due to rotation of the disks 20. Airflow is directed to the combustion chamber 46 and then toward the diffuser 16 until finally being delivered to the engine 80, as previously discussed.

A valve 82 controls the pressure of the air flow provided to the cylinders to ensure that the engine 80 receives the requisite amount of air at each cylinder to thereby ensure that the power output of the engine 80 is maintained at a desired level. In this manner, the regulation mechanism 48 can adjust the flow of compressed air provided to the engine 80 by regulating the amount of air introduced into the compression chamber 46.

A series of temperature, airflow, rotation speed, combustion, pressure and velocity sensors 84 may be mounted within the compression chamber 46, at the outlet 74, and at the respective inlet and outlet ports 34, 36 to aid in controlling the air flow into the compression chamber 46. The sensors 84 provide the compression machine 10 with the ability to increase or decrease an amount of air drawn into the compression chamber 46 based on current operating conditions of both the engine 80 and the compression machine 10. For example, the sensors 84 may provide the compression machine 10 with the ability to compare output pressure and velocity with requirements of the engine 80. Such information is useful in making adjustments to the amount of air injected into the compression chamber 46 to tailor the performance of the compression machine 10 and better match the requirements of the engine 80.

The description is merely exemplary in nature and, thus, variations that do not depart from the gist of the teachings are not to be regarded as a departure from the spirit and scope of the teachings.

What is claimed is:

1. A compression machine comprising:

a housing having an inlet, an outlet, and an inner surface;

a drive shaft including an outer surface having a first portion and a second portion, said first portion including a first slope constant along a length of said first portion and said second portion including a second slope, different than said first slope, and constant along a length of said second portion;

a compression chamber defined by said first portion of said drive shaft, said second portion of said drive shaft, and said inner surface of said housing;

at least one rotating disk having a plurality of blades, said at least one rotating disk rotatably coupled to said drive shaft and disposed within said compression chamber; and at least one stationary disk having a plurality of blades, said at least one stationary disk fixedly attached to said housing and disposed within said compression chamber.

2. The compression machine of claim 1, wherein said at least one rotating disk is attached to said drive shaft at said first portion or said second portion.

3. The compression machine of claim 1, wherein said drive shaft includes a first outer diameter at said inlet and a second outer diameter at said outlet, said second outer diameter being greater than said first outer diameter.

4. The compression machine of claim 1, wherein said drive shaft includes a first outer diameter at said inlet and a second outer diameter at said outlet, said second outer diameter being less than said first outer diameter.

5. The compression machine of claim 1, further comprising a transmission in mechanical communication with said drive shaft.

6. The compression machine of claim 5, wherein said transmission includes at least one tension member extending between said transmission and said drive shaft.

7. The compression machine of claim 6, wherein said tension member is at least one of a cog belt or chain.

8. The compression machine of claim 5, wherein said transmission is a continuously-variable transmission.

9. The compression machine of claim 5, wherein said transmission includes a set of gears.

10. The compression machine of claim 1, wherein said inlet includes a filter.

11. The compression machine of claim 1, further comprising a misting device to cool said plurality of blades of said at least one rotating disk.

12. The compression machine of claim 11, wherein said misting device is disposed at said inlet.

13. The compression machine of claim 11, wherein said misting device includes a nozzle operable to inject a mist of water or coolant into said housing.

14. The compression machine of claim 1, wherein said inner surface of said housing includes a taper.

15. The compression machine of claim 14, wherein said outer surface of said drive shaft includes a taper.

16. The compression machine of claim 1, wherein said at least one stationary disk is integrally formed with said housing.

17. The compression machine of claim 1 further comprising a diffuser operable to convert a portion of a velocity head of a fluid flow to a pressure head.

18. The compression machine of claim 1, wherein at least one of said at least one rotating disk and said at least one stationary disk is associated with said first slope of said first portion and at least one of said at least one rotating disk and said at least one stationary disk is associated with said second slope of said second portion.

* * * * *